US006611669B2

(12) United States Patent
Suzuki et al.

(10) Patent No.: US 6,611,669 B2
(45) Date of Patent: Aug. 26, 2003

(54) IMAGE FORMING APPARATUS WITH SUPERPOSED DIRECT CURRENT AND ALTERNATING CURRENT CHARGING VOLTAGE

(75) Inventors: Jun Suzuki, Shizuoka (JP); Satoshi Tsuruya, Shizuoka (JP); Katsuhiro Sakaizawa, Shizuoka (JP); Masaru Shimura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/921,700

(22) Filed: Aug. 6, 2001

(65) Prior Publication Data

US 2002/0039498 A1 Apr. 4, 2002

(30) Foreign Application Priority Data

Aug. 7, 2000 (JP) ..... 2000-238560

(51) Int. Cl.[7] ..... G03G 15/30; G03G 15/02

(52) U.S. Cl. ..... 399/149; 399/50; 399/174

(58) Field of Search ..... 399/112, 148, 399/149, 150, 168, 174, 175, 176, 223, 298, 299, 302, 50

(56) References Cited

U.S. PATENT DOCUMENTS 5,221,946 A 6/1993 Kohyama
5,519,472 A 5/1996 Ojima et al.
5,602,633 A * 2/1997 Yoshida et al. ..... 399/299
5,822,659 A * 10/1998 Ishiyama ..... 399/175
5,970,279 A 10/1999 Sakaizawa et al. ..... 399/46
5,995,786 A * 11/1999 Ito ..... 399/150
6,026,260 A * 2/2000 Aita et al. ..... 399/175
6,038,420 A * 3/2000 Hirabayashi et al. ..... 399/176
6,052,549 A 4/2000 Shimura et al. ..... 399/176
6,128,456 A 10/2000 Chigono et al. ..... 399/176
6,173,135 B1 1/2001 Yuminamochi et al. ..... 399/66

FOREIGN PATENT DOCUMENTS

JP 4-20986 1/1992

* cited by examiner

*Primary Examiner*—Sandra Brase
(74) *Attorney, Agent, or Firm*—Fitzpatrick, Cella, Harper & Scinto

(57) ABSTRACT

An image forming apparatus includes a flexible charging member, which forms a nip portion between itself and an image bearing member. The charging member charges the image bearing member and is applied with a voltage when the charging member at least charges the image bearing member for an image formation. The nip portion is provided with an electrically conductive particles developing device for developing an electrostatic image formed on the image bearing member with a developer. The developing device executes a developing operation and, at the same time, executes a collecting operation for collecting a residual developer on the image bearing member. The voltage is a superposed voltage with a direct current voltage and an alternating current voltage having a peak to peak voltage, which is less than a peak to peak voltage of the alternating current voltage applied to the charging member when the charging potential of the image bearing member converges under the condition that the charging member charges the image bearing member without the conductive particles.

20 Claims, 10 Drawing Sheets

$$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

IMAGE FORMING APPARATUS WITH SUPERPOSED DIRECT CURRENT AND ALTERNATING CURRENT CHARGING VOLTAGE

BACKGROUND OF THE INVENTION

1. Field of the Invention

The present invention relates to an image forming apparatus such as a laser printer, a copying machine, a facsimile and the like for executing an image formation by adopting an image forming process including a step of uniformly charging an image bearing member with a predetermined polarity and potential to the image bearing member such as an electrophotographic photosensitive member and an electrostatic recording dielectrics.

More specifically, the present invention relates to the image forming apparatus of "cleaning simultaneous with developing" and "cleanerless" by a contact charging system.

2. Description of the Related Art

To describe the image forming apparatus utilizing the electrophotographic system as an example, there is available an image forming apparatus referred to as "cleaning simultaneous with developing" and "cleanerless" wherein, with the object of miniaturizing the whole apparatus, keeping up with the trend of ecology-consciousness without generating a waste toner, allowing a photosensitive drum which is the image bearing member to have a long life and reducing the consumption amount of the toner which is a developer for one page portion, developing means is used as cleaning means for cleaning the toner (hereinafter referred to as the transfer residual toner) which remains on the surface of the photosensitive drum after a toner image has been transferred to a material to be transferred, thereby abolishing the installation of cleaning means as an exclusive device.

(a) In the above described image forming apparatus of "cleaning simultaneous with developing" and "cleanerless", the charging means has been disclosed, for example, in Japanese Patent Application Laid-Open No. 04-20986. This charging means allows a rotary brush, which is an electrically conductive elastic member, to contact the photosensitive drum as a contact charging member and agitate the transfer residual toner on the photosensitive drum, thereby expediting a non-patternization and, at the same time, applies a direct current voltage and an alternating current voltage and allows the photosensitive drum surface to be uniformly charged by an electrical discharge and, furthermore, achieves the "cleanerless". The peak to peak voltage and the charging efficiency of the alternating current voltage on this occasion is typically shown in FIG. 14. In FIG. 14, a point L is a stabilized discharging point and, in the case of the peak to peak voltage up to this or even more, a stabilized discharging can be executed so that a potential on the photosensitive drum comes to be almost the same converging potential as the direct current voltage applied. Because the charging potential is converged by the peak to peak voltage equivalent to the stabilized discharging point, hereinafter the peak to peak voltage, which converges the charging potential, is referred to as "the charging potential convergent voltage".

Accordingly, the charging means of a system for applying a voltage superposed with a direct current component and an alternating current component takes a constitution wherein a peak to peak voltage larger than the charging potential convergent voltage L is applied to the electrically conductive elastic member in order to stabilize a charging.

(b) On the other hand, the image forming apparatus of "cleaning simultaneous with developing" and "cleanerless" which does not use the discharging, but uses the charging means of a direct charging system has been disclosed, for example, in U.S. Pat. No. 6,128,456. This is a system in which electrically conductive charging expediting particles are interposed in the contact portion between a contact charging member and the photosensitive drum and only a direct current voltage is applied and almost the same surface potential of the photosensitive drum as the applied direct current voltage is obtained. Because this system does not actively employ the discharging, there is no ozone generated. Further, because the system does not actively employ the discharging, an adherence of a discharging by-product on the photosensitive drum can be controlled and problems such as a smeared image under high temperatures and high humidity can be prevented.

However, in the image forming apparatus of the cleaning simultaneous with developing, which is provided with a rotary brush using the discharging operation of (a) or the charging means using the direct discharging system of (b) as shown in the above described conventionally described example, there has been the following problem.

That is, similarly to the above described (a), when an image is formed by applying the rotary brush which is the contact charging member with the alternating current voltage superposed with the direct current component, while the image forming is repeated, a toner is accumulated on the rotary brush which is the contact charging member, so that there occurs a problem of a charging defect.

This is because, assuming that the normal charged polarity of the toner as a developer is taken here, for example, as a negative polarity, the transfer residual toner at the point of having passed the transfer means is a toner having the broad distribution of a mixture of the positive polarity and the negative polarity or a majority of the positive polarity due to the influence of the positive transfer bias which is reverse to the charged polarity of the toner and therefore unable to pass through the contact charging means for the following reason and ends up adhering on the charging means.

Concretely, the transfer residual toner is, because there exists a positive toner which is a reverse toner charged with a polarity reverse to the normal polarity, drawn up to the rotary brush by the effect of the electric field working between the rotary brush and the photosensitive drum.

The transfer residual toner adhered on the rotary brush invades the discharging area which is opposite to the photosensitive drum by the rotation of the rotary brush.

In the discharging area, because the discharging has occurred, a positive charge and a negative charge are generated and the negative charge is drawn up to the side of the photosensitive drum and contributes to the charging of the surface of the photosensitive drum. Further, the positive charge generated simultaneously is drawn up to the side of the rotary brush. On this occasion, because the transfer residual toner exists on the surface of the rotary brush, the positive charge adheres on the transfer residual toner so that the toner is increasingly charged with the positive polarity.

Even when passing through the contact portion formed by the rotary brush and the photosensitive drum and the discharging area in the downstream side of the photosensitive drum rotational direction of the contact portion, the positively charged transfer residual toner is drawn up to the side of the rotary brush by the effect of the electric field working between the rotary brush and the photosensitive drum and hence remains adhered on a charging material.

By repeating the above described step, the toner which has adhered on the rotary brush is further strongly charged with the positive polarity and laminated also with a new transfer residual toner, so that the photosensitive drum becomes unable to be charged with a normal surface potential and a charging defect is caused as a result.

Further, when an alternating current voltage is made sufficiently large, because the discharging is stably generated and a discharging amount becomes large, the discharging by-product adheres on the photosensitive drum. The discharging by-product adhered on the photosensitive drum becomes low-resisting under high temperatures and high humidity and therefore an image defect such as a smeared image is apt to occur.

This phenomenon is not limited to the rotary brush alone, but even in the charging means using the contact charging member for executing a charging by a discharging operation, the above described image defect occurs for the same reason.

Further, similarly to the above described (b), in the case where the charging means of the direct charging system is used, when the number of feeding papers is increased, the transfer residual toner adhered to the charging means is accumulated and the charging means is contaminated and becomes defective, so that the defective image was often produced.

This phenomenon is due to the fact that, in the charging means of the direct charging system, the direct current voltage applied to the charging means and the charging potential on the surface of the photosensitive drum are almost the same and, for this reasons the transfer residual toner adhered on the charging means is not electrostatically discharged. Particularly, when a constitution is adapted where a velocity difference is provided between the photosensitive drum and the charging means and the transfer residual toner is actively scraped (stripped) off from the photosensitive drum, the above described image defect becomes remarkable.

SUMMARY OF THE INVENTION

It is an object of the present invention to provide an image forming apparatus, which prevents a charging defect due to contamination of a charging member.

It is anther object of the present invention to provide the image forming apparatus, which makes it easy to return a toner adhered on the charging member to an image bearing member.

It is another object of the present invention to provide the image forming apparatus, which reduces a discharging by-product produced by the charging member.

It is another object of the present invention to provide the image forming apparatus, which controls upsizing and a cost-up of the apparatus and uses the cleanerless system capable of obtaining an excellent image without generating the charging defect over a long period of time by stably executing the charging.

Still another object and characteristics of the present invention will become more apparent by referring to the accompanied drawings and reading the following detailed description.

DETAILED DESCRIPTION OF THE PREFERRED EMBODIMENTS (Embodiment 1)

(A) An Image Forming Apparatus Example

Figure 1:
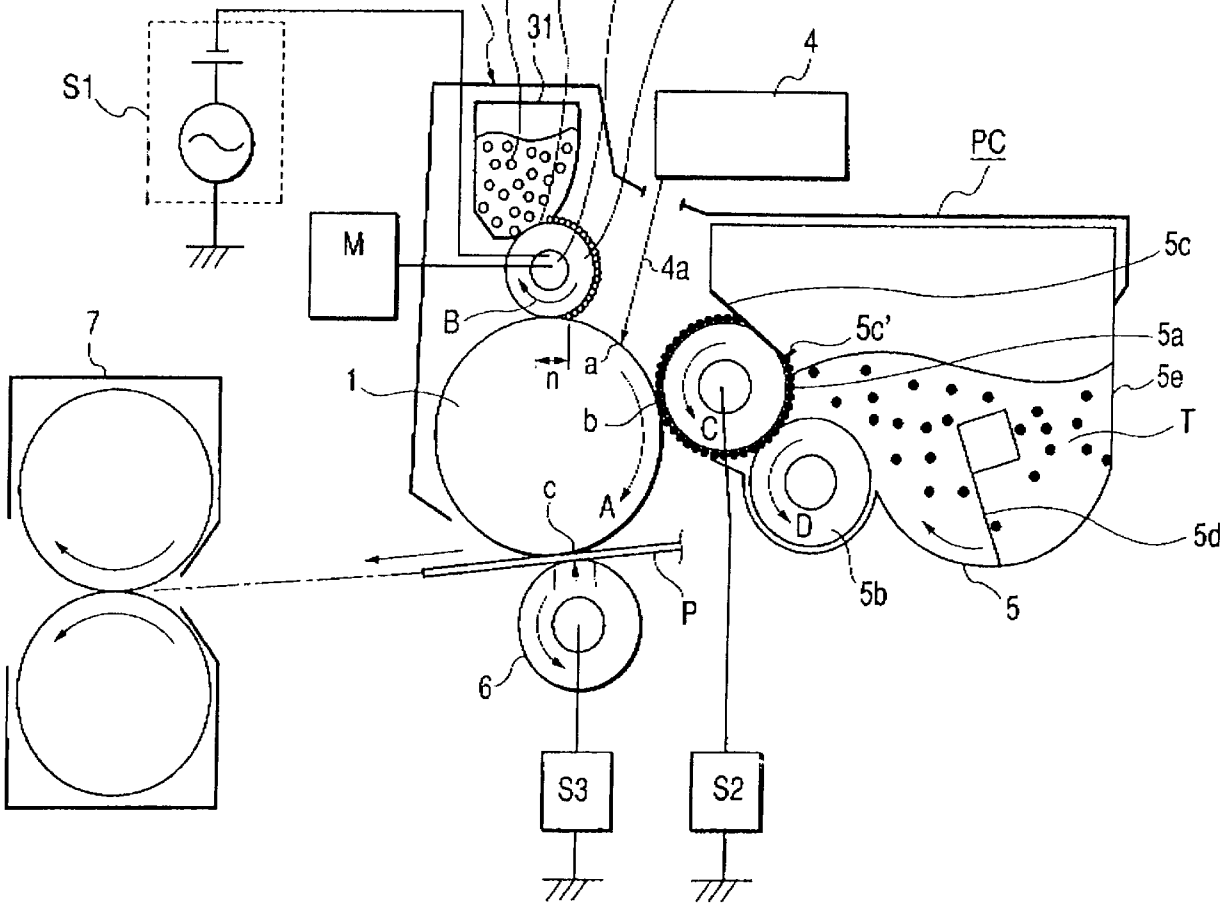
FIG. 1 is a schematic block diagram of an image forming apparatus of an embodiment 1.

FIG. 1 is a typical schematic block diagram of an image forming apparatus according to the present invention. The image forming apparatus of the present invention is a laser printer (an image recording apparatus) of a transfer type electrophotographic system, a contact charging system, a reversal developing system, a cleanerless system and a process cartridge detachably attachable system.

In the printer according to the present embodiment, contact charging means having at least a porous outer peripheral surface and a flexibility is abutted against an image bearing member and the above described contact charging means is applied with a direct current voltage superposed with an alternating current voltage in which a peak to peak voltage is within the range below the charging potential convergent voltage. Further, at least in the contact portion between the above described contact charging means and the image bearing member, there are interposed cleaning auxiliary particles (electrically conductive particles) supplied from cleaning auxiliary particle (electrically conductive particles) supply means. Further, the above described contact charging means strips off the developer remaining on the image bearing member after the transfer and charges the surface of the image bearing member with a predetermined potential and functions as a charge cleaning member for discharging the above described developer in the downstream side of the rotational direction of the image bearing member. The developer discharged from the contact charging member is subjected to the cleaning simultaneous with developing and recycled by developing means which is installed by contacting the image bearing member.

Reference numeral 1 denotes an image bearing member, which is, in the present embodiment, a negative polarity OPC photosensitive member (a cylindrical negative photosensitive member, hereinafter referred to as a photosensitive drum) having a diameter of ϕ30 mm. This photosensitive drum 1 is rotatively driven in a clockwise direction of an arrow mark A with a travelling speed of the peripheral surface at a constant speed of 50 mm/sec (=a process speed).

(1): Charging Step

Reference numeral 2 denotes an elastic roller (hereinafter referred to as a charge cleaning roller) as the charge cleaning member, which is brought into contact with the photosensitive drum 1 by a predetermined pressing force and has an electrical conductivity. Reference character n denotes a charging nip portion, which is a pressuring contact portion between the photosensitive drum 1 and the charge cleaning roller 2. In order to effectively execute the direct charging, it is necessary to take a contact area largely between the photosensitive drum 1 and the charge cleaning roller 2 in the charging nip portion a and, in the present embodiment, the peripheral surface of the charge cleaning roller 2 was made porous, so that the maximum possible contact area could be obtained.

The above described charge cleaning roller 2 bears (carries) the cleaning auxiliary particle z having a conductivity on its peripheral surface and, in the charging nip portion n which is the pressuring contact portion between the photosensitive drum 1 and the charge cleaning roller 2, there is interposed the cleaning auxiliary particle z which is supplied from a cleaning auxiliary particle supply means 3 and which is an electrically conductive particles for the purpose of expediting charging.

The charge cleaning roller 2 is rotatively driven in a reverse direction (counter) to the rotational direction of the photosensitive drum 1 in the charging nip portion n as shown by an arrow mark B and contacts the peripheral surface of the photosensitive drum 1 with a velocity difference. Reference character M denotes a driving source of the charge cleaning roller 2. Further, at the image recording time of the printer, the charge cleaning roller 2 is applied with a predetermined charging bias from a charging bias applying power source S1. In this way, the peripheral surface of the rotational photosensitive drum 1 is subjected to a contact charging process for a predetermined polarity and potential by the direct charging (the injection charging) system.

In the present embodiment, the traveling speed of the peripheral surface of the charge cleaning roller 2 was taken as 75 mm/sec. Here, the traveling speed of the peripheral surface of the charge cleaning roller 2 was taken as a speed in which a predetermined point having an average outer diameter in a state of nothing being abutted against the peripheral surface travels by the rotation of the charge cleaning roller 2. Here, assuming that a peripheral velocity difference between the charge cleaning roller 2 and the photosensitive drum 1 is a rotational speed ratio of both of them, the peripheral velocity difference is 150% in a counter direction in the present embodiment.

In the present embodiment, by the charging bias applying power source S1, a core 2*a* of the charge cleaning roller 2 is applied with the superposed voltage of:

DC voltage: −700 V

AC voltage: Peak to peak voltage 1.0 kV

Frequency 1.8 kHz

Sine wave, so that the peripheral surface of the photosensitive drum 1 is directly charged with almost the same voltage (about −700 V) as the applied DC voltage.

As for the magnitude of the superposed alternating current voltage, because it depends largely upon a dischargeability of the toner (the transfer residual toner) adhered on the charge cleaning roller and remaining on the photosensitive drum without being transferred, the details thereof will be described later.

On the other hand, in the present embodiment, the supply of the cleaning auxiliary particles z to the charge cleaning roller 2 is executed by the cleaning auxiliary particle supply means 3. This cleaning auxiliary particle supply means 3 is constituted by a container 31 housing the cleaning auxiliary particles z and a control blade 32, and adopts such a constitution that the control blade 32 is abutted against the peripheral surface of the charge cleaning roller 2 and the cleaning auxiliary particles z are stored and kept between the charge cleaning roller 2 and the control blade 32 and the cleaning auxiliary particles z are coated on the peripheral surface of the charge cleaning roller 2 by the control blade 32 so as to be supplied to the charge cleaning roller 2.

Further, in the present embodiment, zinc oxide having a specific resistance of about $10^6$ Ω·cm and an average particle size of about 1 μm was used as the cleaning auxiliary particles z.

(2): Exposing Step

Reference numeral 4 denotes a laser beam scanner (an exposing apparatus) including a laser diode, a polygon mirror and the like as information writing means.

This laser beam scanner 4 outputs a laser light, which is modulated in intensity corresponding to the time series electrical digital picture element signal of the object image information and executes a scan-exposure 4*a* of the uniformly charged surface (the peripheral surface of the photosensitive drum 1) of the above described rotary photosensitive drum 1 by the laser light in an exposed portion a. By this scan-exposure 4*a,* the electrostatic latent image corresponding to the object image information is formed on the surface of the rotary photosensitive drum 1.

(3): Developing Step

Reference numeral 5 denotes a developing device, which is a reversal developing device using a nonmagnetic one-component toner (a negative toner) T as a developer. The developing device 5 of the present embodiment is contact developing means in which a developer bearing member contacts the photosensitive drum 1 and comprises: a toner housing container 5*e* which houses a toner T; a developing roller 5*a* as the developer bearing member which contacts the photosensitive drum 1 and, while rotating in the counterclockwise direction to an arrow mark C, executes developing of the electrostatic latent image in the developing region b; a supply roller 5*b* as toner supply means which supplies the toner T to the developing roller 5*a* by rotating in the counterclockwise direction to an arrow mark D; a developing blade 5*c* as toner control means which controls a coating amount and a charging amount of the toner T on the developing roller 5*a*; and an agitation member 5*d* for agitating the toner in the toner housing container 5*e* and supplying the toner T to the supply roller 5*b* and the like.

Because the present embodiment adopts such a constitution that the developing is executed by contacting the photosensitive drum 1 which is a rigid body, the above described developing roller 5*a* desirably has an elasticity. While, as the elastic layer, silicone rubber was used, as the rubber material to be used for the elastic layer, the rubber materials generally used in addition such as NBR rubber (NBR: nitrile rubber), isobutylene-isoprene rubber, natural rubber, acrylic rubber, hydrin rubber, urethane rubber and the like can be used. Usually, by increasing an oil impregnation amount of the above described rubber materials, a low hardness can be attempted. When the developing roller

5*a* is taken as a single layer, when a negative charged toner is used in view of a charge imparting ability to the toner, urethane rubber, silicone rubber, NBR rubber and the like are suitably used. Further, if a positive charged toner is used, fluororubber and the like can be suitably used.

Further, when a coat layer is provided on the elastic layer outer periphery by taking into consideration the charge-imparting ability to the toner, polyamide resin, urethane resin, silicone resin, acrylic resin, fluorocarbon resin or resin which mixes all these resins and the like are suitably used.

As for the developing blade 5*c,* a known toner control member comprising a metal or a rubber and a resin material in the abutting portion with the developing roller 5*a* can be used.

In the present embodiment, the blade used is such that it is bent in a counter direction to the developing roller 5*a* at a position of about 2 mm from the tip end portion of a thin plate (about 0.1 mm t) of stainless steel and the bent portion 5*c*' is in a state of slightly encroaching on the developing roller 5*a*.

The toner T agitated by the agitation member 5*d* is supplied on the developing roller 5*a* by the friction of the abutting portion between the developing roller 5*a* rotating in the C direction and the supply roller 5*b* rotating in the D direction. The toner T on the developing roller 5*a* is given a desired charging amount and a toner amount is controlled by the developing blade 5*c* and the toner is appropriately borne on the developing roller 5*a*.

The developing roller 5*a* is applied with a predetermined developing bias from the developing bias applying power source S2 and the toner borne on the developing roller 5*a* selectively adheres on the surface of the photosensitive drum 1 corresponding to an electrostatic latent image pattern formed on the peripheral surface of the photosensitive drum in the portion to contact the photosensitive drum 1, that is, the developing region b, so that the electrostatic latent image is reversely developed and visualized as a toner image.

The developing bias voltage in the present embodiment was taken as DC voltage: −400 V.

(4): Transfer Step

Reference numeral 6 denotes a medium resistance transfer roller as contact transfer means, which is allowed to contact the photosensitive drum 1 by a predetermined pressing force and forms a transfer nip portion c.

This transfer nip portion c is fed with a transferring material P as a recording medium at a predetermined timing from a sheet feeding portion not shown and, furthermore, the transfer roller 6 is applied with a predetermined transfer bias voltage from the transfer bias applying power source S3, so that the toner images on the peripheral surface of the photosensitive drum 1 are transferred one after another on the transferring materials P fed to the transfer nip portion c.

The transfer roller 6 used in the present embodiment is a roller, which forms a medium resistance foamed layer in a core and has a roller resistance value of $5\times10^8$ Ω and executes a transfer by applying a voltage of +2.0 kV to the core.

On this occasion, in the transfer nip portion c, the toner image of the peripheral surface of the photosensitive drum 1 is attracted and actively displaced to the side of the transferring material P due to the influence of the above described transfer bias. On the other hand, the cleaning auxiliary particles z of the peripheral surface of the photosensitive drum 1 are not actively displaced to the side of the transferring material P because they are electrically conductive, and remain on the peripheral surface of the photosensitive drum 1 by being substantially adhesively held there. Note that, due to the existence of the cleaning auxiliary particles z on the peripheral surface of the photosensitive drum 1, the effect that the transfer efficiency of the toner image from the side of the photosensitive drum 1 to the side of the transferring material P is improved can be obtained.

(5): Fixing Step

Reference numeral 7 denotes a fixing apparatus of a thermal fixing system and the like. The transferring material P In which the toner image of the peripheral surface of the photosensitive drum 1 is transferred in the transfer nip portion c is conveyed and Introduced into the above described fixing apparatus 7 and, upon fixing of the toner image, is discharged outside of the apparatus as an image forming by-product (a print, a copy).

(6): Cleanerless

The transfer residual toner and the cleaning auxiliary particles z which have remained on the peripheral surface of the photosensitive drum 1 after the transfer are conveyed to the charging nip portion n between the photosensitive drum 1 and the charge cleaning roller 2 by the rotation of the photosensitive drum 1, so that the cleaning auxiliary particles z are supplied to the charging nip portion n and adhered and mixed on the charge cleaning roller 2. That is, in the charging nip portion n formed by the photosensitive drum 1 and the charge cleaning roller 2, the contact charging of the photosensitive drum 1 in a state in which the cleaning auxiliary particles z exist is executed.

In the image forming apparatus of the present embodiment, because it adopts a cleanerless constitution, an exclusive cleaner (a cleaning apparatus) such as a cleaning blade and the like are not installed and consequently, accompanied with the rotation of the photosensitive drum 1, the transfer residual toner which remains on the peripheral surface is of the photosensitive drum 1 after the toner image was transferred to the transferring material P reaches the developing region b through the charging nip portion n and is collected (recovered) and recycled by the cleaning simultaneous with developing executed by the developing device 5.

Figure 2:
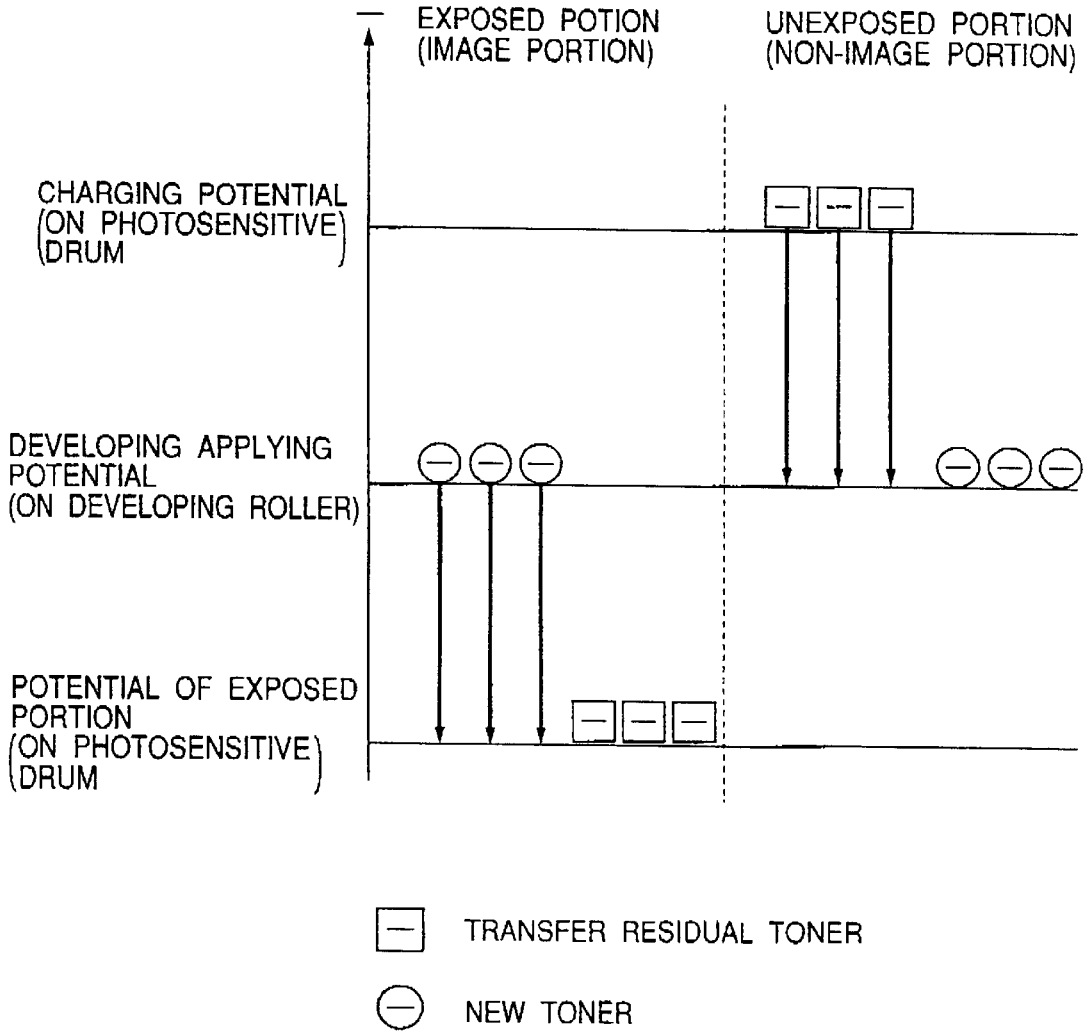
FIG. 2 is an explanatory view of a cleaning simultaneous with developing system.

The cleaning simultaneous with developing will be described below with reference to FIG. 2. In the drawing, the character "□" shows the transfer residual toner existing on the surface of the photosensitive drum 1; the character "○" shows a new toner which has passed the developing blade 5*c* and borne on the developing roller 5*a*; and the character "-" shows a charge polarity of the toner.

The transfer residual toner (the toner not transferred to the transferring material P, but remaining on the surface of the photosensitive drum 1 in the transfer step) is influenced in the contact portion n (the charging nip portion) between the photosensitive member 1 and the charge cleaning roller 2 by the friction between the photosensitive member 1 and the charge cleaning roller 2 and the frictional charging operation of the cleaning auxiliary particles z (positive charged polarity) and becomes a negative charged toner which is of a normal charge polarity. Subsequently, by the exposing step, the exposed portion (the image portion) of the surface of the photosensitive member 1 becomes about −150 V. Further, in the developing step, the transfer residual toner on the above described exposed portion remains on the photosensitive member 1 as it is and, furthermore, due to a potential difference (about 250 V) between the developing bias (−400 V) and the above described exposed portion, the new toner borne on the developing roller 5*a* is supplied (developed) to the above described exposed portion. At the same time, the transfer residual toner of the negative charge of a nonexposed portion (a nonimage portion) is displaced on the developing roller 5*a* due to the potential difference between the charging potential (about −700 V) on the photosensitive member 1 and the developing bias (−400 V). On this occasion, the new toner borne on the developing roller 5*a* remains on the developing roller 5*a* as it is, so that the cleaning simultaneous with developing is executed.

(B) Process Cartridge

The printer of the present embodiment is taken as a detachably attachable as well as exchangeable process cartridge PC for the printer main body by integrating three process machines of the photosensitive drum 1, the charge cleaning roller 2 and the developing device 5.

What is meant by the process cartridge is that the charging means, the developing means or the cleaning means are integrally put into a cartridge with the image bearing member and this cartridge is made detachably attachable to the image forming apparatus main body. And at least one of the charging means, the developing means and the cleaning means is integrally put into a cartridge with the image bearing member and that cartridge is made detachably attachable to the image forming apparatus main body. Further, at least the developing means and the image bearing member are integrated with the cartridge and that cartridge is made detachably attachable to the image forming apparatus main body.

(C) Charge Cleaning Roller 2

The charge cleaning roller 2 in the present embodiment is formed by forming on the core 2*a* a semiconductor layer 2*b* of a foaming member in a roller shape prescribed by a resin (for example, urethane), electrically conductive particles (for example, carbon black), a sulfidizing agent, a foaming agent and the like.

Further, the charge cleaning roller 2 can use, in addition to the above described resin (urethane and the like), EPDM, NBR, silicone rubber, a foamed rubber material in which carbon black for use of a resistance adjustment for IR and the like and electrically conductive substances such as metallic oxide and the like are dispersed, and those subjected to a foaming process on the peripheral surface only and made porous. Particularly, the resistance adjustment can be made by using ion electrically conductive materials without dispersing electrically conductive substances.

The charge cleaning roller 2 at least makes the peripheral surface minutely porous so as to allow a contact chance of the toner to the peripheral surface of the photosensitive drum 1 to increase and, when the transfer residual toner flows into the charging nip portion n, vacant holes play a role of catching the toner and stripping it off the peripheral surface of the photosensitive drum 1, and the contact of mutual members can be kept.

In the charging nip portion, by making the rotational direction of the charge cleaning roller 2 a counter direction to the rotational direction of the photosensitive drum 1, the transfer residual toner is stripped off once from the peripheral surface of the photosensitive drum 1 and the direct charging can be effectively executed in a state in which there is scarcely any transfer residual toner interposed in the charging nip portion n formed by the charge cleaning roller 2 and the photosensitive drum 1. With the transfer residual toner reaching the charging nip portion n from the transfer nip portion c scratched off, the previous image pattern is prevented from appearing as a ghost particularly in a halftone image.

By polishing the surface of the roller of the semiconductor layer 2*b* formed as described above as occasion demands, the charge cleaning roller 2 which is the electrically conductive elastic roller having a diameter of 12 mm and a longitudinal length of 200 mm was prepared.

On the other hand, when a roller resistance of the charge cleaning roller 2 of the present embodiment was measured, it was 100 kΩ. The roller resistance was measured in a state in which an aluminum drum having a diameter of ϕ30 mm is contact bonded with the charge cleaning roller 2 so that a weighting of a total pressure 9.8N (1 kg) is applied to the core 2*a* of the charge cleaning roller 2 by applying 100 V between the core 2*a* and the aluminum drum.

It is important for the charge cleaning roller 2 to function as an electrode. That is, it is necessary to obtain a sufficient contact state with a member to be charged by giving an elasticity and keep a resistance sufficiently low to be able to charge a moving member to be charged. On the other hand, when there exists a low withstanding pressure failure region such as a pinhole and the like in the member to be charged, it is necessary to prevent a leak of voltage. When the electrophotographic photosensitive member is used as the member to be charged, it is desirable that the charge cleaning roller 2 has a resistance of $10^4$ to $10^7$ Ω in order to attain a sufficient chargeability and a leakproof.

Regarding the hardness of the charge cleaning roller 2, if the hardness is too low, the shape is not stabilized and a contactability with the member to be charged (the photosensitive drum) becomes worse, while if the hardness is too high, not only the charging nip portion n cannot be held between the roller 2 and the member to be charged but also a microscopic contactability to the surface of the member to be charged becomes worse and hence 25 degrees to 50 degrees are within a desirable range by ASKER C hardness.

(D) Toner T

The toner T to be used in the present embodiment will be described in detail. The toner referred to here is constituted by toner particles and an external additive.

In the image forming apparatus of the present embodiment, while it is possible to use the toner obtainable from the conventionally known pulverizing method, polymerizing method and the like, the use of the toner particles to be described as follows is particularly suitable.

Regarding the toner particles according to the present invention, the value of a shape factor SF-1 measured by an image analysis apparatus is 100 to 150 and it is preferable that the value of the shape factor SF-2 is 100 to 140. If the value of the shape factor SF-1 is 100 to 140 and the value of the shape factor SF-2 is 100 to 120, it is more preferable. When the above described conditions are satisfied and, furthermore, the value of (SF-2)/(SF-1) is set 1.0 or less, not only the various characteristics of the toner particles, but also the matching with the image forming apparatus becomes extremely excellent.

The SF-1 and the SF-2 which show the shape factors used in the present invention are such that the toner particle images magnified by a magnification of X 500 by using FE-SEM (S-800) made by Hitachi, Ltd. are randomly subjected to a sampling test in 100 pieces and the image information thereof is introduced to the image analysis apparatus (Luzex 3) made by Nicolet Japan Corporation through an interface and analyzed, and the values obtained by calculating by the following equations are defined as the shape factors SF-1 (FIG. 3) and SF-2 (FIG. 4):

$$\text{SF-1}=\{(\text{MXLNG})^2/\text{AREA}\}\times(\pi/4)\times 100$$

$$\text{SF-2}=\{(\text{PERI})^2/\text{AREA}\}\times(1/4\pi)\times 100$$

AREA: Toner particles projected area

MXLNG: Absolute maximum length

PERI: Periphery

The shape factor SF-2 of the toner particles shows a degree of roundness of the toner particles, which gradually becomes an indefinite shape from a spherical shape. The SF-2 shows a degree of concavity and convexity of the toner particle, which makes concavity and convexity of the surfaces of the toner particles remarkable.

When the above described shape factor SF-1 exceeds 160, because the shape of the toner particles becomes an indefinite shape, a charging amount distribution of the toner particles becomes broader and the toner particle surface is apt to be ground in the developing device thereby creating one of the factors of the lowering of the image density or an image fog.

In order to raise the transfer efficiency of the toner particle image, the value of the shape factor SF-2 is 100 to 140, it is preferable that the value of (SF-2)/(SF-1) is 1.0 or less. When the value of the shape factor SF-2 is more than 140 and the value of (SF-2)/(SF-1) exceeds 1.0, the surfaces of the toner particles are not smooth and a large number of concavities and convexities are possessed by the toner particles, so that the transfer efficiency from the photosensitive drum 1 to the transfer paper P and the like tends to be lowered.

Further, as for the toner particles to be used in the present invention, it is preferable that the toner particles with the toner particle surfaces coated with an external additive (containing the cleaning auxiliary particle to be described later) are used so that the toner particles are given a desired charging amount.

For this reason, an external additive coating ratio of the toner particle surface is preferably 5 to 99% and more preferably 10 to 99%.

Regarding the external additive coating ratio of the toner particle surface, the toner particle image is randomly subjected to a sampling test in 100 pieces by using FE-SEM (S-800) made by Hitachi, Ltd. and the image information thereof is introduced to the image analysis apparatus (Luzex 3) made by Nicolet Corporation through the interface. The image information to be obtained is binary-valued because lightness with the toner particle surface portion and the external additive portion is different, and is calculated by the following equation with the information divided into an area SG of the external additive portion and an area ST (including the area of the external additive portion) of the toner particle portion:

$$\text{External additive coating ratio } (\%) = (SG/ST) \times 100.$$

As for the external additive, silica and the like which are publicly used can be cited.

The external additive is used in 0.01 to 10 weight parts for 100 weight parts of the toner particles and is preferably used in 0.05 to 5 weight parts. Further, the external additives may be used singly or in combination. In either case, the additive subjected to a hydrophobic process may be more preferable.

When the additive amount of the external additive is below 0.01 weight part, a flowability of a one-component system developer becomes worse and the efficiency of the transfer and the developing is reduced and irregularity of the image density and the so-called flying out of the toner which flies out around the vicinity of the image portion occur. On the other hand, when the amount of the external additive exceeds 10 weight parts, the excessive external additive adheres on the photosensitive drum 1 and the developing roller, so that the chargeability to the toner becomes worse and the image is disturbed.

(E) Cleaning Auxiliary Particles z

Regarding the cleaning auxiliary particles z to be used in the present embodiment, as its material, a variety of electrically conductive particles such as a mixture of electrically conductive inorganic particles and organic substances of metallic oxide (for example, aluminum oxide, titanium oxide, tin oxide, zinc oxide and the like) or those particles subjected to a surface treatment and the like can be used.

A particle resistance was calculated as a specific resistance as shown below. The calculation of the specific resistance was made such that, inside a cylinder having a base area of 2.26 $cm^2$, a powder sample of about 0.5 g was poured and upper and lower electrodes were applied with a pressurization of 147N (15 kg) and, at the same time, by applying a voltage of 100 V, a resistance value was measured and, after that, normalization was executed.

The resistivity of the cleaning auxiliary particles z calculated by the above described method needs to be $10^{12}$ Ω·cm or less in order to execute delivery and receipt of charge through the cleaning auxiliary particles z and preferably $10^{10}$ Ω·cm or less.

Regarding the particle size of the cleaning auxiliary particles z, 100 pieces or more were extracted from an observation by an optical or electron microscope and a volume particle size distribution was calculated based on a horizontal maximum angular distance and 50% average particle size thereof was decided as the particle size.

The particle size of the cleaning auxiliary particles z calculated by the above described measurement is preferably 0.1 μm to 3 μm in order that the particles are operated as a micro-carrier or a space-carrier to be described later. When the particle size is equal to or less than 0.1 μm, the particles easily adhere on the toner having a generally used particle size and follow the behavior of the toner and therefore their effect as the spacer-carrier is diminished. On the other hand, when the particle size exceeds 3 μm, it is difficult for the particles to intervene in the toner and have a sufficient contact with it and therefore it is difficult for the particles to negatively polarize the toner.

There is no problem in that the cleaning auxiliary particles z not only exist in a state of primary particles but also exist in an aggregated state of secondary particles.

Whatever aggregation it is, if a function as the cleaning auxiliary particles can be realized as an aggregation, the form of the aggregation is not important.

On the other hand, taking into consideration the fact that the cleaning auxiliary particles z adhere on the photosensitive drum 1 or a part of them is transferred from the photosensitive drum 1 to the recording material P, specifically in a full color image forming apparatus, unless white or nearly transparent particles are used, a color reproducibility is in danger of being spoiled. Further, when the cleaning auxiliary particles z are used for charging the photosensitive drum 1, It is important that they do not cause disturbance (do not shade the light) at the time of latent image exposure and, after all, it is desirable that white or nearly transparent particles are used, and they are preferably non-magnetic.

(F) Direct Charging (Injection Charging), Toner Discharging

In the present invention, as a charging system, an injection charging which is a direct charging system is employed. That is, the charge cleaning roller 2 composed of a porous surface is allowed to rub the photosensitive drum 1 at a peripheral velocity difference provided so that it can be charged to a desired potential. However, in the cleanerless system which is not specifically provided with a cleaning container, the toner (transfer residual toner) which is not transferred from the photosensitive drum 1 to the transferring material P in a transfer step, but remains on the photosensitive drum 1 directly reaches the charge cleaning roller 2.

In the image forming apparatus of the present embodiment, when, accompanied with the rotation of the photosensitive drum 1, the transfer residual toner reaches the upstream side of the rotational direction of the photosensitive drum 1 of the charging nip portion n which the charge cleaning roller 2 and the photosensitive drum 1 forms, the toner is scratched off from the surface of the photosensitive drum 1 by a mechanical frictional force produced on the wall of vacant holes of the charge cleaning roller 2 driven at a velocity difference provided and on the peripheral surface of the photosensitive drum 1. The transfer residual toner scratched off as described above, accompanied with the rotation of the charge cleaning roller 2, reaches the downstream side of the rotational direction of the photosensitive drum 1 of the above described charging nip portion n. At the same time, in the above described charging nip portion n, a charge is injected on the peripheral surface of the photosensitive drum 1 from the surface of the charge cleaning roller 2, and the charging of the peripheral surface of the photosensitive drum 1 is executed and the surface potential on the photosensitive drum 1 to be charged almost reaches the applied direct current voltage value.

On the other hand, the charge clearing roller 2 is applied with the alternating current voltage superposed with the direct current voltage, and an alternating electric field is formed between the charge cleaning roller 2 and the photosensitive drum 1. Accordingly, accompanied with the rotation of the charge cleaning roller 2, the transfer residual toner which has reached the downstream side of the rotational direction of the photosensitive drum 1 of the above described charging nip portion n repeats going and coming between the peripheral surface of the photosensitive drum 1 and the peripheral surface of the charge cleaning roller 2 by the potential difference continuously generated on the surface of the photosensitive drum 1 and the peripheral surface of the charge cleaning roller 2. On this occasion, the photosensitive drum 1 is rotating, and the transfer residual toner which is adhered and is borne on the photosensitive drum 1 slips away from the operating area of the above described alternating electric field, so that the toner is discharged from the peripheral surface of the charge cleaning roller 2.

Here, by operating as the micro-carrier or the spacer-carrier, the cleaning auxiliary particles z borne on the peripheral surface of the charge cleaning roller 2 can effectively execute the above described discharging. That is, the particles z give a support for clearing the toner from the roller 2.

That is, in the midst of the process in which the transfer residual toner and the cleaning auxiliary particles z are mixed and borne on the peripheral surface of the charge cleaning roller 2, the cleaning auxiliary particles z operate as the micro-carrier, that is, the particles z themselves are positively polarized by frictional charging, so that a negative charge is given to the transfer residual toner. Further, the cleaning auxiliary particles z operate as the spacer-carrier by intervening between the charge cleaning roller 2 and the transfer residual toner and, by the operation of the alternating electric field in the downstream side of the rotational direction of the photosensitive drum 1 of the above described charging nip portion n, the toner can be easily discharged from the charge cleaning roller 2. Further, the polarity of the discharged toner is also negatively polarized, so that a toner recovery by the developing roller 5*a* in the next step can be certainly executed.

The alternating current voltage which is applied to the charge cleaning roller 2 is preferably large in a potential gradient per unit hour. This is because it is considered that, the larger the potential gradient is, the larger the potential difference on the peripheral surface of the charge cleaning roller 2 and the surface of the photosensitive drum 1 is. Further, by effectively discharging the toner, the surface of the charge cleaning roller 2 is brought into contact with the peripheral surface of the photosensitive drum 1 always in an exposed state and consequently high chargeability for the photosensitive drum 1 can be secured. Further, when the surface of the charge cleaning roller 2 is exposed, the wall of vacant holes can tightly rub the peripheral surface of the photosensitive drum 1 and therefore can increase the recoverability of the subsequent transfer residual toner.

Figure 5:
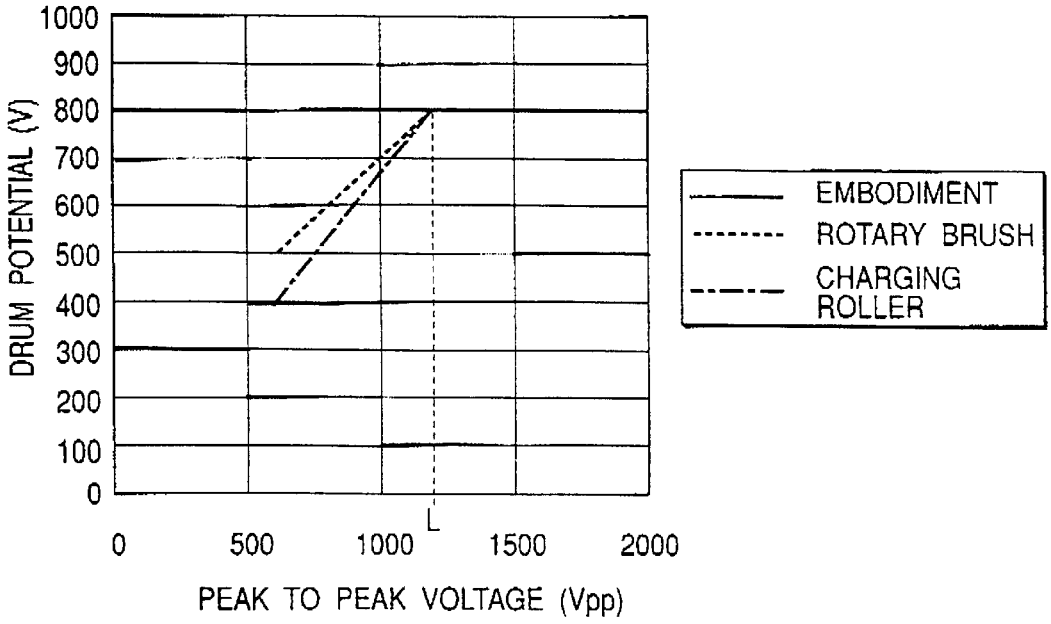
FIG. 5 is a view showing a chargeability when a direct current voltage is superposed with an alternating current voltage as a charging applying bias.

Further, the present invention adopts the injection charging system and therefore in FIG. 5, in the present invention, the charging is made by using the peak to peak voltage which is an L point or less. Accordingly, in order to charge the surface of the photosensitive drum 1, a discharge operation is not mainly employed and consequently the toner is not positively polarized.

Even when the positively polarized and the negatively polarized toners are mixed in the transfer residual toner, in the charging nip portion n formed by the charge cleaning roller 2 and the photosensitive drum 1, the transfer residual toner is rubbed at the time of being scratched off from the peripheral surface of the photosensitive drum 1 or the transfer residual toner which is rubbed at the time of being scratched off from the peripheral surface of the photosensitive drum 1 as described above and adhered and borne on the charge cleaning roller 2 and invades the above described charging nip portion n again is rubbed by reaching the charging nip portion n again so that, combined with the operation as the micro-carrier of the above described cleaning auxiliary particles, the transfer residual toner is charged and negatively polarized.

The magnitude of the alternating current voltage to be applied with the direct current voltage superposed is desirably equal to or more than 500 V in the peak to peak voltage and, furthermore, less than a charging potential convergent voltage. When the peak to peak voltage becomes equal to or less than 500 V, the potential difference (between the charge cleaning roller 2 and the peripheral surface of the photosensitive drum 1) for discharging the toner by the above described alternating current voltage cannot be obtained, and it is difficult to strip off the toner from the charge cleaning roller 2 and allow the toner to make a reciprocating movement between the roller and the photosensitive drum 1. On the other hand, when the peak to peak voltage is equal to or more than the charging potential convergent voltage, the discharging operation of the charge cleaning roller 2 is intensified, and in this case too, no potential difference is generated for discharging the toner which has adhered on the charge cleaning roller 2. Accordingly, it becomes difficult for the toner to be allowed to make the reciprocating movement between the roller and the photosensitive drum 1 with the result that the toner becomes accumulated on the charge cleaning roller 2. Further, when the discharging operation is intensified, it ends up with the occurrence of the positive polarization of the toner.

The dominance of the charge by the discharging operation with the peak to peak voltage being equal to or more than the charging potential convergent voltage means that the operation exceeds the peak to peak voltage two times a threshold value of the discharging starting voltage. That is, by exceeding the peak to peak voltage two times the threshold value of the discharging starting voltage, an AC discharging is stably maintained, which is contrary to the operation to be described in the image forming apparatus of the present invention. The peak to peak voltage may be less than 1200 V.

(G) Difference from the Conventional Charging System

Here, the conventional charging system different from the image forming apparatus of the present invention will be described.

Figure 6:
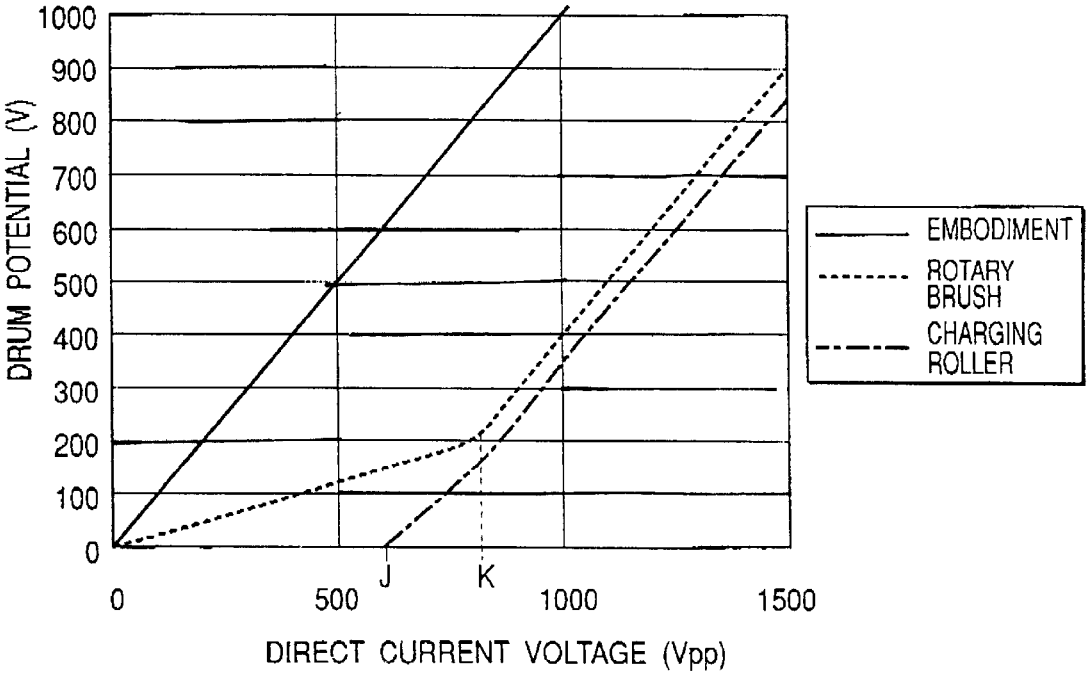
FIG. 6 is a view showing the chargeability when the direct current voltage only is applied as the charging applying bias.

FIG. 5 is a view showing chargeability in the case of the voltage which is superposed with the alternating current voltage with the direct current voltage as a charging applying bias, and FIG. 6 is a view showing the chargeability in the case of applying the direct current voltage only as the charging applying bias.

Although, as described above, in the present embodiment, the peak to the peak voltage of the alternating current voltage which is applied with the direct current voltage superposed is taken as less than the charging potential convergent voltage, the cleaning auxiliary particles z are interposed in the charge cleaning roller 2 and the above described charge cleaning roller 2 is driven at a peripheral velocity difference from the photosensitive drum 1 provided, so that the toner can be charged to the same potential as the direct current voltage to be applied on the peripheral surface of the photosensitive drum 1 without utilizing the discharging operation.

Figure 3:
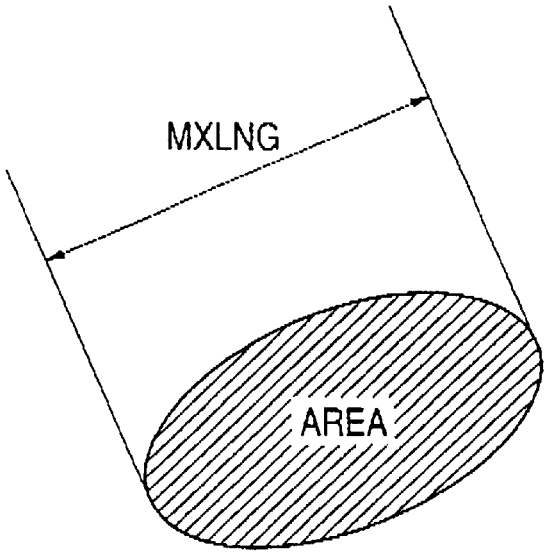
FIG. 3 is an explanatory view of a toner shape factor SF-1.
Figure 4:
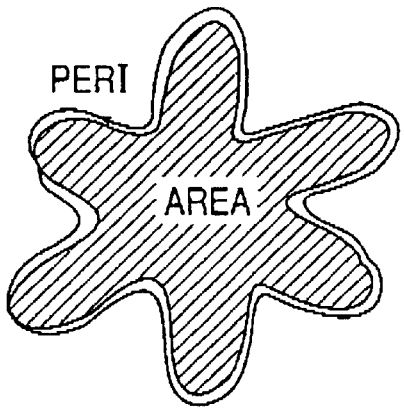
FIG. 4 is an explanatory view of the toner shape factor SF-2.

On the other hand, it is necessary to apply the alternating current voltage comprising the peak to peak voltage which is equal to or more than the L point (1200 Vpp in the present embodiment constitution) which is the charging potential convergent voltage in FIG. 3 to the charge cleaning roller (hereinafter, referred to as a discharging roller) for executing the charging by utilizing the discharging operation. However, when the alternating current voltage comprising the peak to peak voltage which is equal to or more than the L point is applied, because a continuous discharging occurs on the discharging roller, it becomes difficult to create a potential difference between the discharging roller and the photosensitive drum 1 and there are some disadvantages in that the toner adhered on the discharging roller cannot be effectively discharged on the photosensitive drum 1. Further, because positive ions generated by the discharging are attracted to the side of the discharging roller which is lower in the potential than the surface of the photosensitive drum 1, the toner adhered on the discharging roller is reversely polarized (a nonchargeable toner is positively polarized).

In this way, the discharging roller is accumulated with the transfer residual toner and unable to charge the photosensitive drum to the normal surface potential and causes a charging defect. Even if the above described reversely polarized toner is stripped off from the discharging roller by a mechanical rubbing force and discharged to the photosensitive drum 1, the toner cannot be recovered to the developing device, but becomes an image fog to cause a deformity to an output image. In order to secure a stable chargeability, the discharging roller makes the surface of the charge cleaning roller as smooth as possible. For this reason, the roller is poor in a stripping off ability of the transfer residual toner and, with the transfer residual toner remaining on the photosensitive drum as it is, executes a series of processes such as charging, exposing, developing and the like which are related to the subsequent image forming. As a result, not only the uniformity of the image is spoiled but also the formation of high fidelity latent image cannot be executed for a desired image of imaging, and there sometimes develops an image defect in which the residual image at the time of the preceding image forming appears with the image to be subsequently formed as the so-called memory image (a ghost image).

Although the above described tendency can be similarly observed in the case of the charging by using the rotary brush, when the AC charging system is used specifically in the rotary brush, because the transfer residual toner is drawn into the brush, deformation such as solidification of the brush due to a long term usage sometimes occurs.

Among the charging systems which use the discharging, the DC charging system which applies the direct current voltage only requires a voltage application equal to or more than J, K points in FIG. 6. Because the DC charging system is weaker in the discharging operation (the charge imparting ability is poor) compared to the AC charging system, the operation to positively polarize to an extreme degree the toner adhered on the discharging roller is poor and hence the amount thereof is reduced, but the positively polarized toner is accumulated on the discharging roller similarly to the case of the AC charging system. As described above, when the toner is accumulated on the discharging roller, a uniform discharging is hard to occur in a discharging area and, as a result, charging on the photosensitive drum 1 cannot be executed to a desired potential. In the case of the charging by using the rotary brush, similarly to the case of the AC charging system, the transfer residual toner is drawn into the brush and solidification of the brush occurs easily.

On the other hand, when the direct current voltage only is applied to the charge cleaning roller 2 in the image forming apparatus of the present embodiment, because the potential difference is not generated in the downstream side of the rotational direction of the photosensitive drum 1 of the charging nip portion n which the charge cleaning roller 2 and the photosensitive drum 1 form, an operation for discharging the toner adhered on the peripheral surface of the charge cleaning roller 2 is not produced. Accordingly, in this case too, the contamination of the charge cleaning roller 2 is developed, so that the injection chargeability is reduced so as to cause a charging defect.

Note that the charge cleaning roller 2 which is used in the present embodiment is slavishly driven relative to the drum so that the peripheral velocity difference relative to the photosensitive drum 1 is eliminated, and when, in a state in which the cleaning auxiliary particles z are not interposed, the potential of the peripheral surface of the photosensitive drum is measured by changing the peak to peak voltage of the alternating current voltage to be applied with the direct current voltage superposed, the charging potential convergent voltage (the L point) shown in FIG. 5 can be remarkably observed.

That is, because execution of the slavish rotation and elimination of the particles generate a discharging charging instead of the injection charging, the L point may be observed by artificially generating the discharging charging.

Accordingly, in the image forming apparatus of the present embodiment, the maximum possible effect can be obtained by deciding the peak to peak voltage of an alternating current voltage in such a manner that the peak to peak voltage becomes less than the charging potential convergent voltage (the L point) in the measurement made under the above described conditions.

Further, when the alternating current voltage is superposed and applied in the injection charging which is the direct charging system, the surface potential on the photosensitive drum 1 follows in the applied voltage, thereby causing a minute deflection of the potential. However, in the present embodiment, by using a contact developing system for the developing system, it was found that this problem could be solved.

Figure 7:
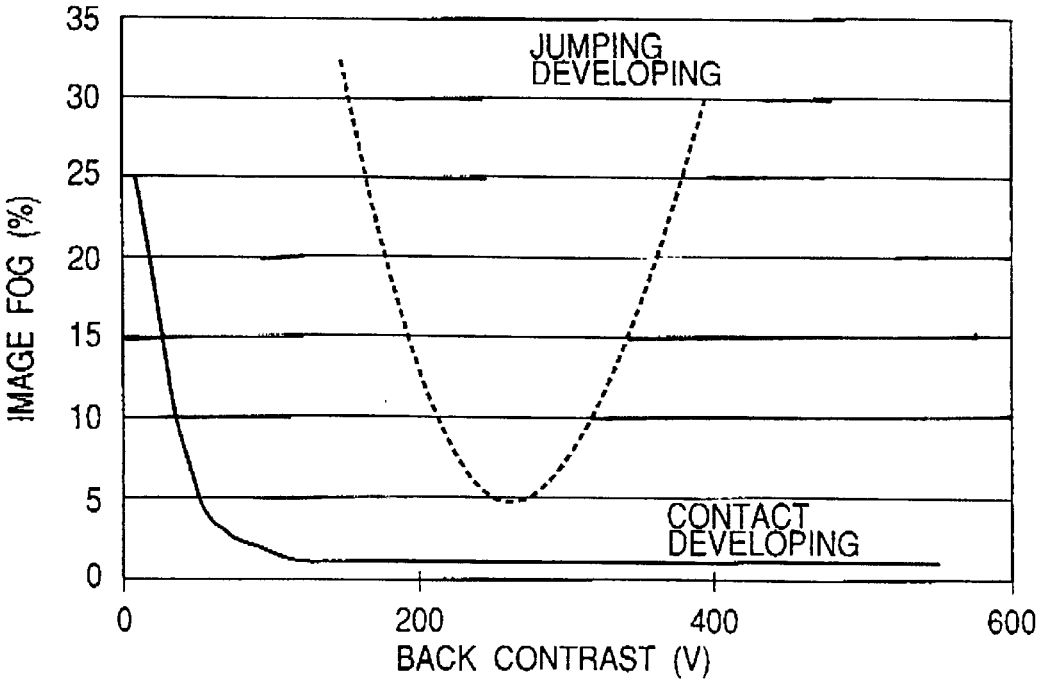
FIG. 7 is a view showing the difference of an image fog in noncontact developing and contact developing.

Although the present charging means can be used without depending on the developing system, in the experimental studies of the present inventors, it was found that there arose a difference in the quality of the images outputted respectively in the contact developing system and the noncontact developing system. The result is shown in FIG. 7. FIG. 7 shows a difference of the image fog in the noncontact developing and the contact developing. In FIG. 7, in the noncontact developing (a jumping developing), the excellent range of the fog by a back contrast (the absolute value of the difference between the surface potential on the charged photosensitive drum 1 and the developing direct current voltage) is narrow. This is due to the fact that in the jumping developing, the toner itself makes a reciprocating movement between a developer bearing member and the photosensitive drum 1, thereby reviving (visualizing by the toner) the minute deflection of the potential on the photosensitive drum 1. Because the deflection of the surface potential of the photosensitive drum 1 means the deflection of the back contrast, when a minute deflection of the potential is on a nonimage portion, it becomes foggy and invites deterioration of the image quality.

However, because the contact developing system has little change in the fog by the back contrast and the value of the fog is extremely small, even if the surface potential on the photosensitive drum 1 is slightly deflected, the fog does not increase and no deterioration of the image quality is invited. Further, in the recovery of the transfer residual toner too, which has been discharged from the charge cleaning roller 2, because the toner is scratched off once by the developing roller by the mechanical rubbing force, the recovery of the transfer residual toner can be easily made.

Accordingly, in case of using the charging system of the present invention, it was found that utilization of the contact developing system as the developing system is more suitable.

As described above, in the image forming apparatus of the present invention, the cleaning auxiliary particles z are interposed in the contact portion n between the charge cleaning roller 2 and the photosensitive drum 1, and the direct current voltage superposed with alternating current voltage in which the peak to peak voltage is less than the charging potential convergent voltage is applied to the above described charge cleaning roller 2, so that, the above described charge cleaning roller 2 is allowed to function as a charge cleaning member in such a manner that, after the transfer, the transfer residual toner which has remained on the peripheral surface of the photosensitive drum 1 is scratched off and, at the same time, the peripheral surface of the photosensitive drum 1 is charged to a predetermined potential and, furthermore, the transfer residual toner is discharged in the downstream side of the rotational direction of the photosensitive drum 1, and the contamination of the above described charge cleaning roller 2 is prevented so that high quality output image with few charging defects and fog can be obtained over a long period of time.

Estimation of Embodiment Examples

In order to examine the effects of the image forming apparatus of the present embodiment, together with comparative examples 1, 2, 3 and 4 as shown below, an image output endurance test of successive 1000 prints was made in a predetermined pattern to estimate an occurrence level of a ghost image and a comparison of merits and demerits of the chargeability in each image forming apparatus was made.

Because the image forming apparatus of the present embodiment and each of the comparative examples adopts a reversal developing system, the above described ghost image means that the portion (the toner image portion) which was image-exposed at a first rotation of the photosensitive member causes a charging defect at a second rotation of the photosensitive member and consequently the preceding image pattern portion appears with the toner developed more than that of the other portion (the image density is high).

Figure 8:
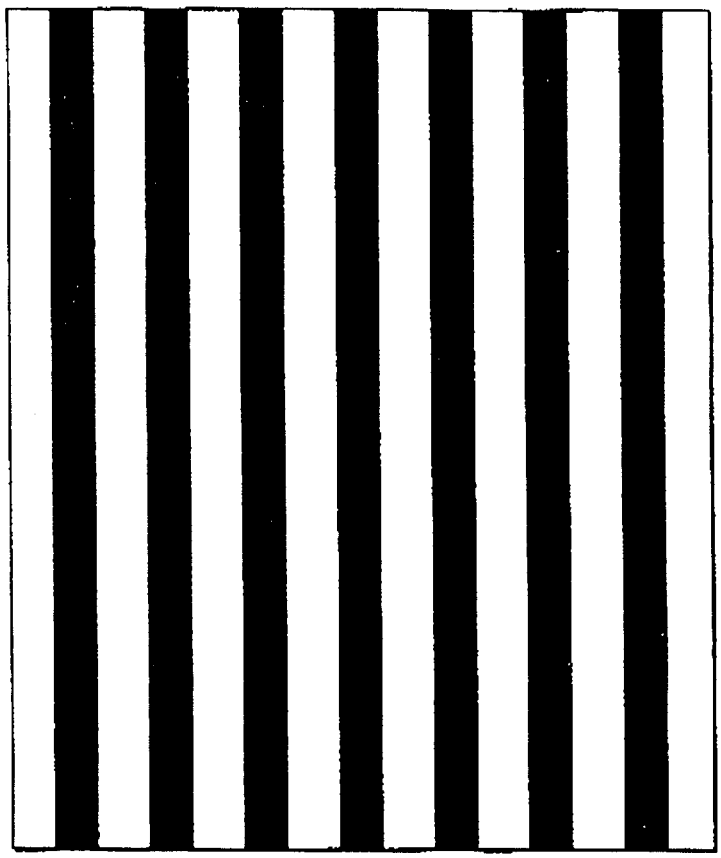
FIG. 8 is a view showing an image sample used for an estimation of an embodiment example in the image forming apparatus of the embodiment 1.

For the image pattern for use of the endurance test, a combination of vertical belts and blank spaces as shown in FIG. 8 was selected. Further, a halftone image (the whole surface) was outputted at a predetermined timing and used for the judgment of incidence level of the above described ghost image.

Comparative Example 1

Figure 9:
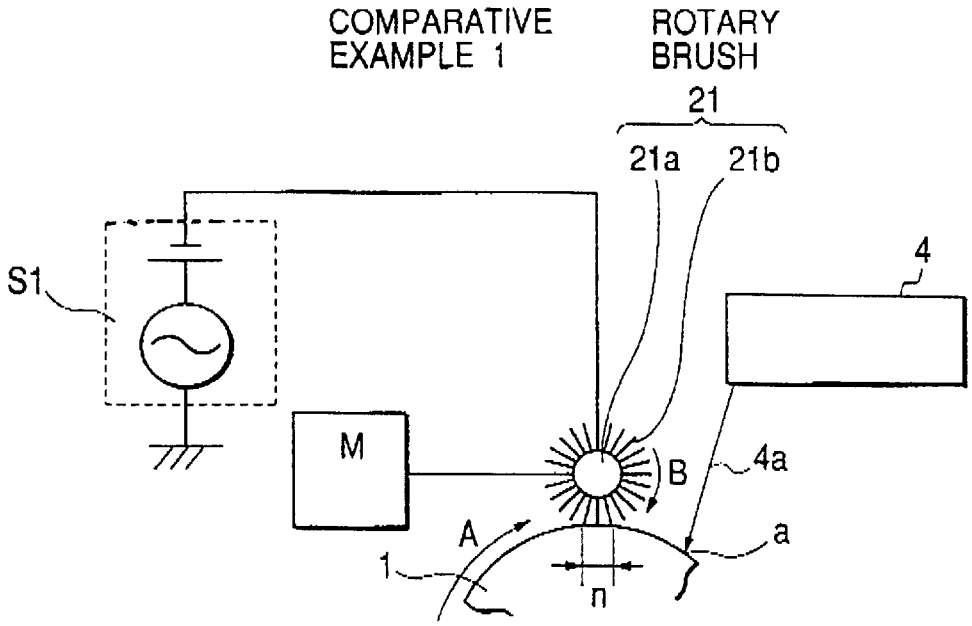
FIG. 9 is a schematic block diagram of principal components of the image forming apparatus of a comparative example 1.

In the image forming apparatus (FIG. 1) of the present embodiment, the image forming apparatus of the comparative example 1 uses a rotary brush 21 as shown in FIG. 9 instead of the charge cleaning roller 2 as a contact charging member, and this rotary brush 21 is applied with a bias which is superposed with AC and DC and executes a charging of the peripheral surface of the photosensitive drum 1 by using the discharging operation.

The rotary brush 21 is such that an electrically conductive fiber 21*b* is radially installed around the core 21*a* which is made of metal. The rotary brush 21 is, similarly to the image forming apparatus of the present embodiment, rotatively driven in a reverse direction (counter) to the rotational direction of the photosensitive drum 1 and contacts the peripheral surface of the photosensitive drum 1 with the velocity difference of 150%. Further, the rotary brush 21 is applied with a bias which is superposed with AC and DC from the charging bias applying power source S1 and charges the peripheral surface of the photosensitive drum 1 with about −700 V.

The constitution of the image forming apparatus of the present embodiment was correspondingly applied to the image forming apparatus constitution other than the above described.

Comparative Example 2

Figure 10:
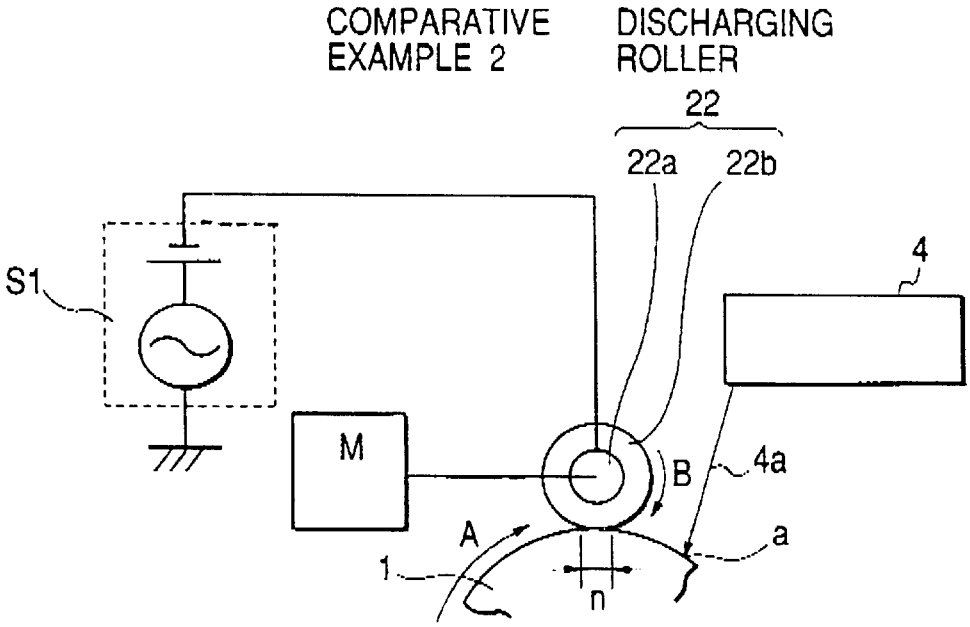
FIG. 10 is a schematic block diagram of principal components of the image forming apparatus of a comparative example 2.

In the image forming apparatus (FIG. 1) of the present embodiment, the image forming apparatus of the comparative example 2 uses a discharging roller 22 as shown in FIG. 10 instead of the charge cleaning roller 2 as the contact charging member, and the discharging roller 22 is applied with a bias which is superposed with AC and DC, and a charging of the peripheral surface of the photosensitive drum 1 is executed by using a discharging operation.

The discharging roller 22 is prepared by forming a medium resistive layer 22*b* of solid rubber as a flexible member on the core 22*a*. The medium resistive layer 22*b* is prescribed by resin (for example, urethane), electrically conductive particles (for example, carbon black), sulfidizing agent and the like and formed in a roller shape on the core 22*a*.

The discharging roller 22 is, similarly to the image forming apparatus of the present embodiment, rotatively driven in a reverse direction (counter) to the rotational direction of the photosensitive drum 1 and contacts the peripheral surface of the photosensitive drum 1 at the velocity difference of 150%. Further, the discharging roller 22 is applied with a bias which is superposed with AC and DC from the charging bias applying power source S1 and charges the peripheral surface of the photosensitive drum 1 with about −700 V.

The constitution of the image forming apparatus of the present embodiment was correspondingly applied to the image forming apparatus other than the above described.

Comparative Example 3

In the image forming apparatus (FIG. 1) of the present embodiment, the image forming apparatus of the comparative example 3 was such that the bias applied to the charge cleaning roller 2 was DC only and a charging of the peripheral surface of the photosensitive drum 1 was executed by the direct charging (the injection charging) system.

Comparative Example 4

In the image forming apparatus (FIG. 1) of the present embodiment, the image forming apparatus of the comparative example 4 was such that the developing system was changed to the jumping developing system. As for the bias which is applied to the developing, the bias superposed with AC and DC is applied.

(Estimation Result)

The ghost image estimation result for the endurance test made in the present embodiment and each of the image forming apparatuses of comparative examples 1 to 4 will be shown in the following Table 1.

TABLE 1

| Image forming apparatus | After 100 prints | After 500 prints | After 1000 prints | other image defects |
|---|---|---|---|---|
| Embodiment 1 | good | good | good | none |
| Comparative example 1 | fair | fair | fail | density irregularity (in a shape of longitudinal stripe) |
| Comparative example 2 | fair | fail | fail | density irregularity (in a shape of longitudinal stripe) |
| Comparative example 3 | good | fair | fail | density irregularity (in a shape of longitudinal stripe) |
| Comparative example 4 | fair | fair | fail | image fog on entire surface |

Here, a guideline for the estimation is shown below.
Good: No image defect (No charging defect).
Fair: A slight increase in density due to a ghost image or a slight fog.
Fail: A large increase in density due to a ghost image or a large fog.
The estimation was made according to the above guide line.

In the image forming apparatus of the present embodiment, no ghost image or other image deficiencies occurred until the endurance test was completed at a point of 1000 prints.

In the comparative example 1, the toner which entered the rotary brush 21 at around 500 prints were accumulated and became hard to generate a discharge. As a result, the charge did not become uniform in a longitudinal stripe shape and a ghost image portion became higher than the density of the vicinity. The increase of the density was generated like the ear of the brush. At the point of 1000 prints, the ghost became worse and a desired halftone was not obtained, but became a solid density to cause a charging defect.

In the comparative example 2, similarly to the comparative example 1, a density irregularity occurred at the point of 100 prints due to the charging defect of the longitudinal stripe shape. In the discharging roller 22, unlike the rotary brush 21, there is no space for accumulating the toner. Accordingly, it is considered that the charging defect due to the adhesion of the toner has occurred faster than the comparative example 1.

In the comparative example 3, at the point of 100 prints, the adhesion of the toner to the charge cleaning roller 2 was still a little, but at the point of 500 prints, some ghosting occurred and, at the point of 1000 prints, the image density which should primarily be of a halftone portion became high, thereby causing a charging defect.

In the comparative example 4, a thin image fog occurred from the beginning, at the point of 1000 prints, the toner accumulated on the peripheral surface of the charge cleaning roller 2 and the whole surface became foggy, thereby causing an image defect.

As described above, in the image forming apparatus of the present embodiment, it was possible to obtain high quality output image with few charging defects or image fog over a long period of time.

(Embodiment 2)

The image forming apparatus of the present embodiment houses the cleaning auxiliary particles z, which have been supplied from the cleaning auxiliary particle supply means 3 in the image forming apparatus (FIG. 1) of the above described embodiment 1, in the developing means by uniformly dispersing them in the toner as the developer by a mixer. By making the supply of the cleaning auxiliary particles from the developing means, the contamination of the charging member is prevented by a simple constitution and the cleaning simultaneous with developing is realized so that a high quality output image with few charging defects and image fog can be obtained over a long period of time.

In addition, from among the image forming components, the image bearing member and the charging member, which are relatively intensively consumed, and the developing means including the toner are integrated and made into a process cassette detachably attachable to the image forming apparatus main body so as to attempt to reduce the user's efforts relative to various maintenance operations.

Figure 11:
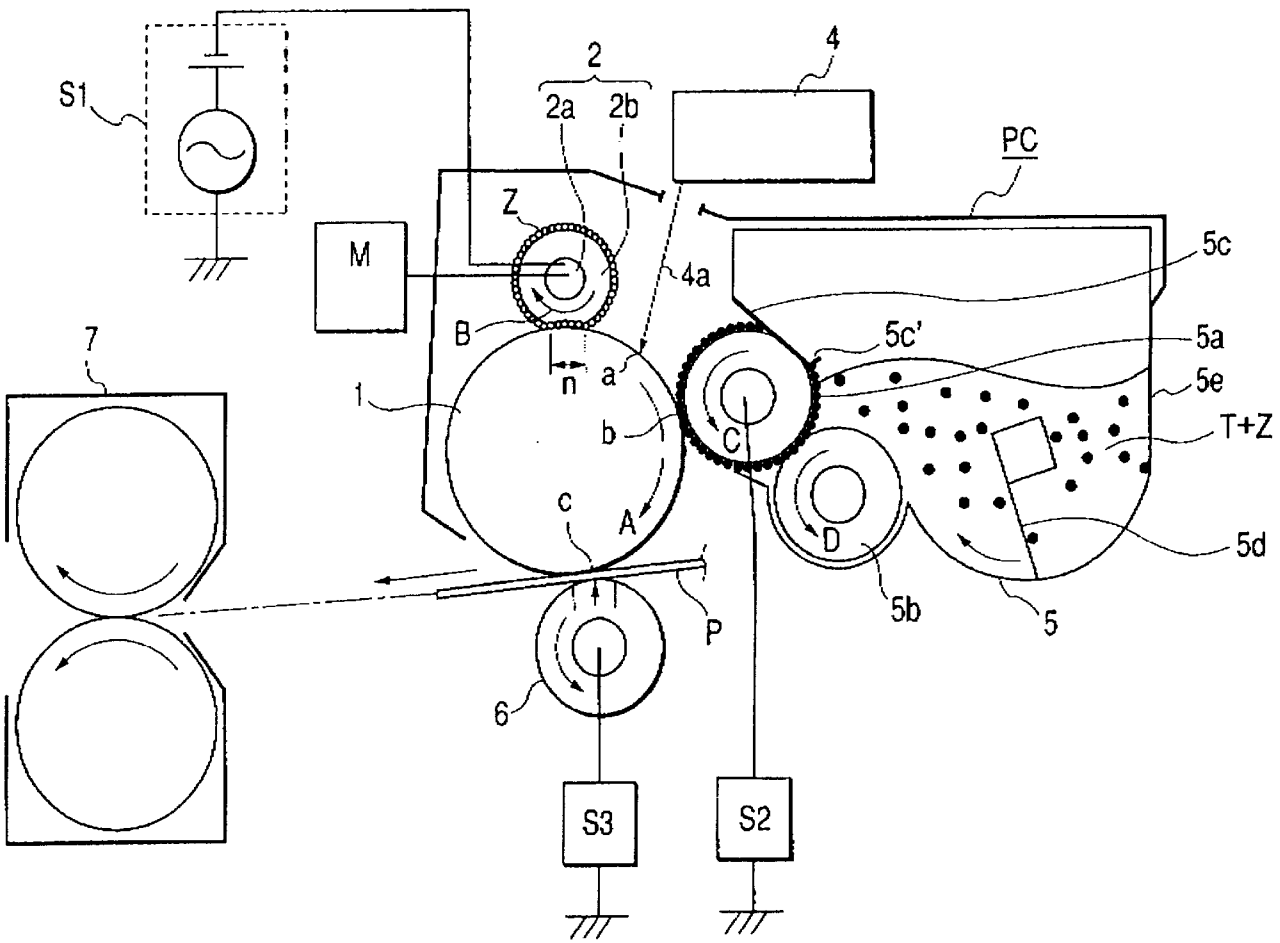
FIG. 11 is a schematic block diagram of the image forming apparatus of an embodiment 2.

FIG. 11 is a typical schematic block diagram of the image forming apparatus of the present embodiment. In the image forming apparatus (FIG. 1) of the above described embodiment 1, the image forming apparatus of the present embodiment is deprived of the cleaning auxiliary particle supply means 3 for the charge cleaning roller 2, and the cleaning auxiliary particles z are uniformly dispersed to the toner T by the mixer and housed inside a toner housing container 5*e* of the developing device 5 as the developer.

In the present embodiment, as the cleaning auxiliary particles z, zinc oxide having a specific resistance of $10^6$ Ω·cm and an average particle size of 1 μm was used. Then 2.0 weight parts of the zinc oxide as the cleaning auxiliary particles z were added to 100 weight parts of the toner T used in the embodiment 1 and subsequently classified, and uniformly dispersed by the mixer and housed inside the toner housing container 5*e* of the developing device 5. The particles z are provided with the charge polarity in reverse to the charge polarity of the toner.

The charge cleaning roller 2 has been previously coated with the cleaning auxiliary particles z.

In the present embodiment, an applied charging bias to the charge cleaning roller 2 was taken as a superposed voltage of:

DC voltage: −700 V

AC voltage: Peak to peak voltage 0.8 kV

Frequency 1.8 kHz

Sine wave

By applying this charging bias, the peripheral surface of the photosensitive drum 1 is directly charged with almost the same voltage (about −700 V) as the above described applied DC voltage.

The constitution of the image forming apparatus of the embodiment 1 was correspondingly applied to the image forming apparatus other than as above described.

The cleaning auxiliary particles z which were dispersed to the toner T which is the developer of the developing device 5 are mixed with the toner at the developing time of an electrostatic latent image of the surface of the photosensitive drum 1 and adhered on the surface of the photosensitive drum 1.

Then the toner image of the peripheral surface of the photosensitive drum 1 in the transfer nip portion c is attracted to the side of the transferring material P due to the effect of the transfer bias and actively displaced. On the other hand, the cleaning auxiliary particles z on the peripheral surface of the photosensitive drum 1 are, because of being electrically conductive, not actively displaced to the side of the transferring material P, but substantially adhesively held and remain on the peripheral surface of the photosensitive drum 1. Note that, because of the existence of the cleaning auxiliary particles z which were adhesively held on the peripheral surface of the photosensitive drum 1, it also has the effect of improving the transfer efficiency of the toner image from the side of the photosensitive drum 1 to the side of the transferring material P.

The transfer residual toner which remained on the peripheral surface of the photosensitive drum 1 after the transfer and the above described cleaning auxiliary particles z are, by the rotation of the photosensitive drum 1, conveyed to the charging nip portion n between tile photosensitive drum 1 and the charge cleaning roller 2, which induces a supply of the cleaning auxiliary particles z to the charging nip portion n and adhesion and inclusion of the particles to the charge cleaning roller 2.

That is, in a state where the cleaning auxiliary particles z exist in the charging nip portion n which the photosensitive drum 1 and the charge cleaning roller 2 form, the contact charging of the photosensitive drum 1 is executed.

Because the image forming apparatus of the present embodiment adopts the cleanerless constitution, a cleaner (a cleaning device) such as a cleaning blade is not installed, and the transfer residual toner is, by the operation as described with reference to FIG. 2 in the embodiment 1, recovered and recycled by executing the cleaning simultaneous with developing in the developing device 5. On this occasion, the cleaning auxiliary particles which fall off from the charging nip portion n and the charge cleaning roller 2 are also recovered in the developing portion b by the developing device 5 and mixed into a developer T and circulatively used.

Further, as an image forming operation advances, even when the cleaning auxiliary particles z fall off from the charging nip portion n and the charge cleaning roller 2, because the cleaning auxiliary particles z which are contained in the developer T of the developing device 5 move to the peripheral surface of photosensitive drum 1 in the developing portion b and sequentially continue to be supplied to the charging nip portion n through the transfer nip portion c by the movement of the peripheral surface of the photosensitive drum 1, the cleaning auxiliary particles z continue to exist in the charging nip portion n so that an excellent chargeability can be maintained over a long period of time.

As described above, because the cleaning auxiliary particles z exist in the charging nip portion n, by a lubricant effect of the particles z, a frictional resistance between the photosensitive drum 1 and the charge cleaning roller 2 can be reduced and no excessive load is given to mutually rubbing members and a driving source M and the charge clearing roller 2 can be allowed to effectively contact the peripheral surface of the photosensitive drum 1 at a velocity difference provided, Further, by providing a velocity difference between the charge cleaning roller 2 and the photosensitive drum 1, a chance for the cleaning auxiliary particles z to contact the photosensitive drum 1 is markedly increased in the charging nip portion n between the charge cleaning roller 2 and the photosensitive drum 1 and a high contactable performance can be obtained. Accordingly, the cleaning auxiliary particles z which exist in the charging nip portion n between the charge cleaning roller 2 and the photosensitive drum 1 rub closely the peripheral surface of the photosensitive drum 1 so that the charge is effectively directly injected to the photosensitive drum 1, and the contact charging of the photosensitive drum 1 by the charge cleaning roller 2 becomes dominant in the direct charging (the injection charging) due to the existence of the cleaning auxiliary particles z.

As described above, in the image forming apparatus of the present embodiment, the cleaning auxiliary particles z are interposed in the contact portion n between the charge cleaning roller 2 and the photosensitive drum 1, and the direct current voltage superposed with the alternating current voltage in which the peak to peak voltage is less than the charge potential convergent potential is applied to the charge cleaning roller 2, so that the above described charge cleaning roller 2 is allowed to function as a charge cleaning member in such a manner that, after the transfer, the transfer residual toner which has remained on the peripheral surface of the photosensitive drum 1 is scratched off and, at the same time, the peripheral surface of the photosensitive drum 1 is charged to a predetermined potential and, furthermore, the transfer residual toner is discharged in the downstream side of the rotational direction of the photosensitive drum 1, and the contamination of the above described charge cleaning roller 2 is prevented, so that it became possible to obtain high quality output image with few charging defects and image fog over along period of time.

Further, by executing the supply of the cleaning auxiliary particles z from the developing means 5, the contamination of the charging member 2 could be prevented by a simple constitution and still further miniaturization and reduction in cost of the apparatus could be realized.

In the image forming apparatus of the present embodiment, from among the image forming components, the photosensitive drum 1 and the charge cleaning roller 2, which are relatively intensively consumed, and the developing means 5 including the developer T are integrated and made into a process cartridge PC detachably attachable to the image forming apparatus main body. Accordingly, this led to the reduction of the user's efforts relative to various maintenance operations such as replenishing of the toner and replacement of the photosensitive drum 1 the life of which has expired and the like and acquisition of stable output images by a simple operation.

By previously bearing the cleaning auxiliary particles z on the charge cleaning roller 2, from the initial using period of the process cartridge, the direct charging performance can be displayed without any trouble.

(Embodiment 3)

Figure 12:
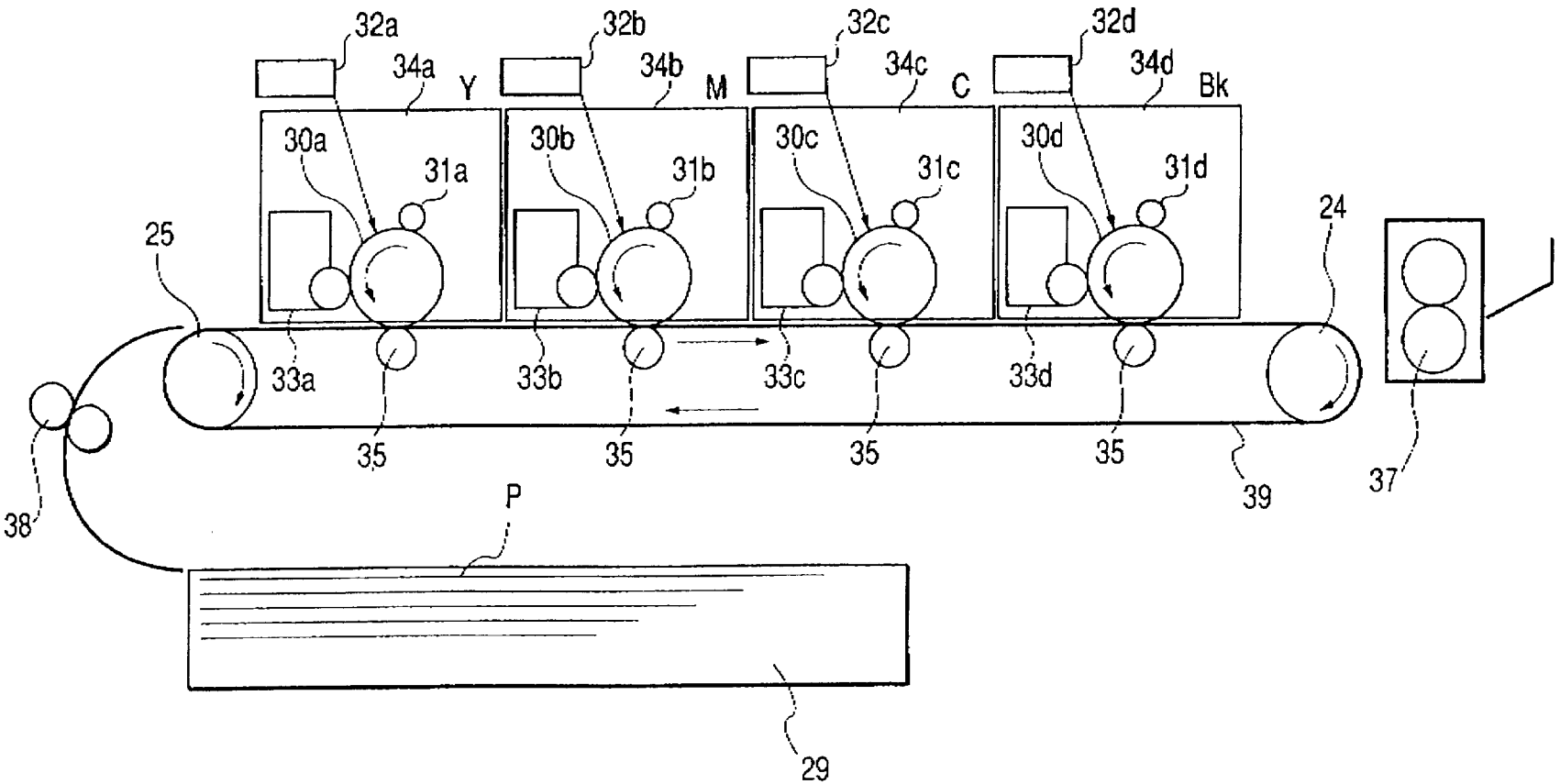
FIG. 12 is a schematic block diagram of the image forming apparatus of an embodiment 3.

FIG. 12 is a typical schematic block diagram of the image forming apparatus of the present embodiment. This image forming apparatus is a full color image forming apparatus of a tandem system, the color image forming apparatus comprising a plurality of image bearing members, a plurality of charging means for charging the above described image bearing members, respectively, a plurality of developing means for respectively developing the electrostatic latent images formed on the charging surfaces of respective image bearing members by a plurality of toners and forming the toner image of each color and a plurality of transfer means for transferring the above described toner images of a plurality of colors in order to the members to be transferred, wherein at least one of the above described respective charging means is a contact charging apparatus for charging the surface of the image bearing member by a flexible charging member, which forms a contact portion with the image bearing member, and the surface in which the above described charging member contacts at least the image bearing member is porous and driven for the image bearing member at a velocity difference provided and, at least at the image recording time, is applied with the alternating current voltage superposed with the direct current voltage.

Y, M, C and Bk are four image forming means portions from the 1st to the 4th which form images of different colors, respectively. These image forming means portions comprise photosensitive drums 30*a* to 30*d* which are image bearing members, charging means 31*a* to 31*d,* image exposing means 32*a* to 32*d* and developing means 33*a* to 33*d,* respectively. Then the respective image forming means portions are integrated with the photosensitive drums 30*a* to 30*d,* the charging means 31*a* to 31*d* and developing means 33*a* to 33*d,* respectively and adopt the forms of process cartridges 34*a* to 34*d.* The process cartridge is such that the replacement of main parts is easy and improvement of the user maintenance is attempted.

The 1st image forming means portion Y executes the image formation by a yellow toner, the 2nd image forming means portion M by a magenta toner, the 3rd image forming means portions C by a cyan toner and the 4th image forming means portion Bk by a black toner.

Here, the developing means 33*a* to 33*d* of the 1st to the 4th image forming means portions Y, M, C and Bk are similarly constituted except that the toner of each color of yellow, magenta, cyan and black is involved inside the developing device.

The image forming operation will be described below in detail.

In each of the 1st to the 4th image forming means portions Y, M, C and Bk, on the surfaces of the uniformly charged photosensitive drums 30*a* to 30*d* by each charging means 31*a* to 31*d,* laser beams modulated according to the image data from a host such as a personal computer and the like are irradiated by image exposing means 32*a* to 32*d,* and a desired electrostatic latent image for each color is obtained. This latent image is visualized as a reversely developed toner image in the developing region by the developing means 33*a* to 33*d* which are developing device and which are installed opposite to this image and involve the toners of each color.

First, in the 1st (the first color) image forming means portion Y, a yellow toner image is formed on the photosensitive drum 30*a* and, during this time, a recording paper P as a member to be transferred is fed by sheet feeding means such as a sheet feeding roller and the like from a transferring material housing portion 29 such as a cassette and conveyed to a pair of resist rollers 38. The recording paper P stops once at the pair of resist rollers 38 and, after that, is absorbed and conveyed at a predetermined timing by an absorbing roller not shown to an electrostatic conveying belt 39 which is hooked between a driving roller 24 and a slave roller 25 and transferred on a nip portion between itself and the transfer roller 35.

Subsequently, in the 2nd (the second color), the 3rd (the third color) and the 4th (the fourth color) image forming means portions M, C and Bk, the same steps are followed, respectively and the toner image of each color of magenta, cyan and black is multi-transferred in order on the same recording paper P from each photosensitive drum 30*b,* 30*c* and 30*d* and thus a color toner image is formed.

The color toner image which was transferred on this recording paper P is melt fixed by fixing means 37 such as a fixing apparatus and the like, permanently fixed on the recording paper P, and discharged from a sheet discharging portion to a discharge tray in a face-up direction and a desired color print image is obtained.

The members which constitute each of the 1st to the 4th image forming means portions Y, M, C and Bk or each of the process cartridges 34*a* to 34*d,* the voltages applied to each member and the like use those of the same constitution as the image forming mechanism of the embodiment 1 or the embodiment 2.

With such a color image forming apparatus, as described in the embodiment 1 or the embodiment 2, by using the contact charging member of the direct charging system, a stable cleanerless system can be realized by a simple constitution.

(Embodiment 4)

Figure 13:
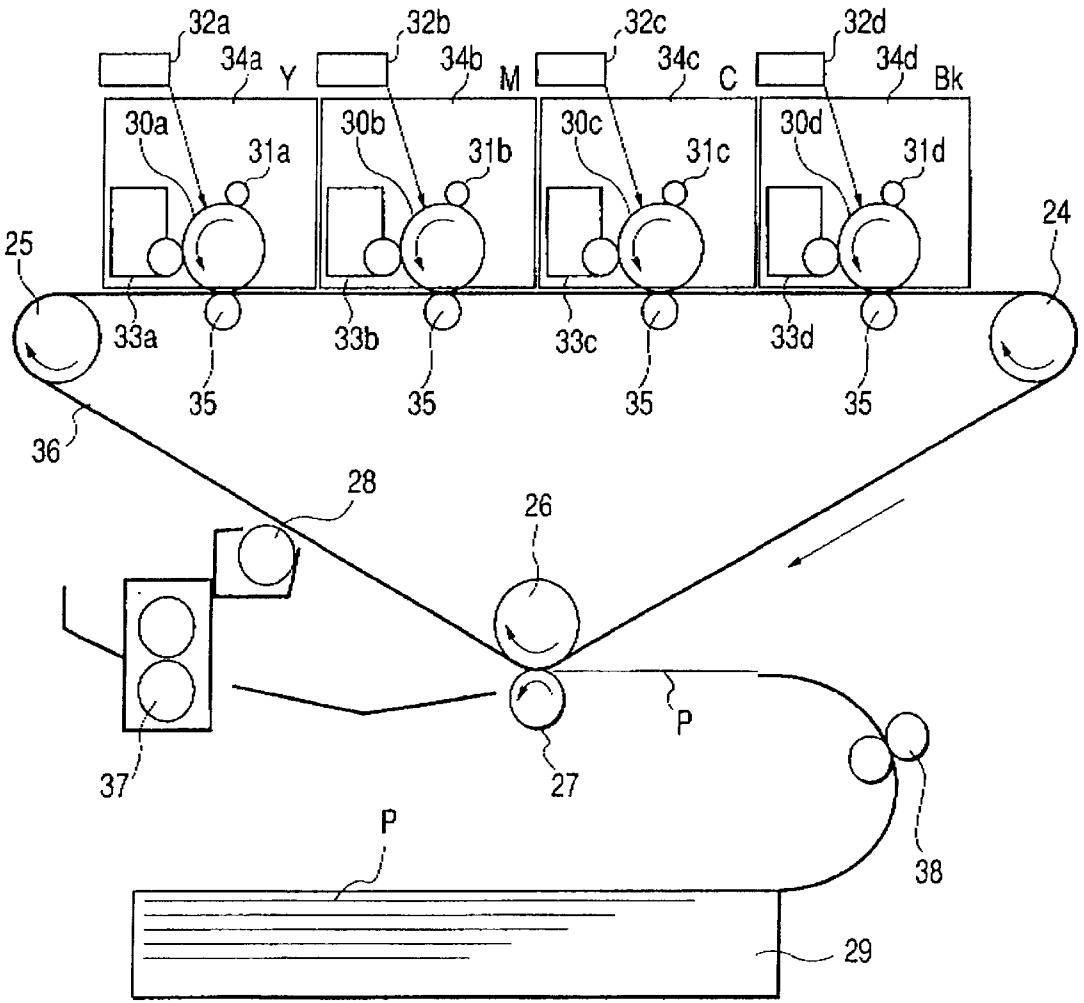
FIG. 13 is a schematic block diagram of the image forming apparatus of an embodiment 4.
Figure 14:
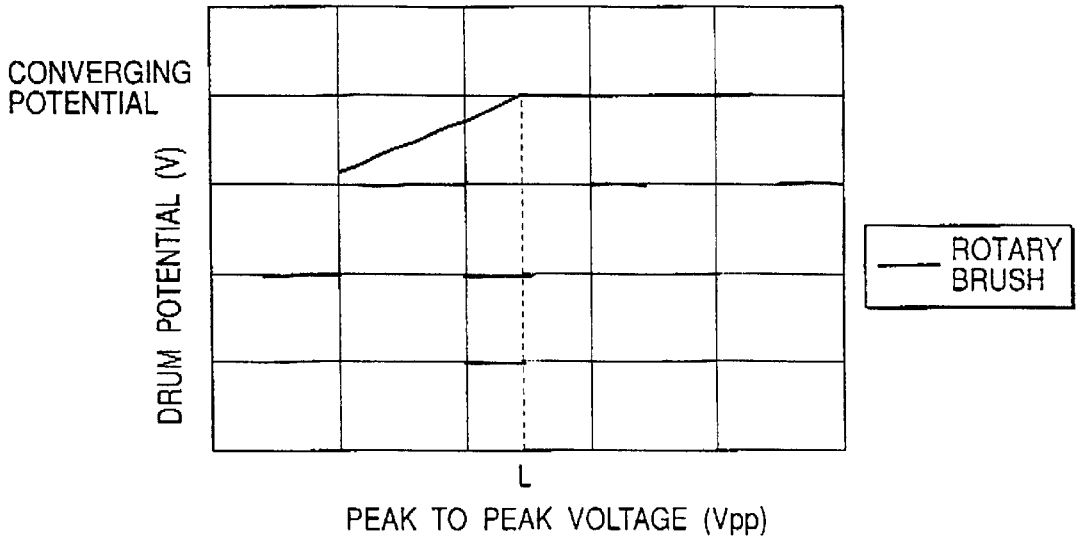
FIG. 14 is a view showing a charging efficiency depending on the difference of a charging member in the conventional example (AC).

The present embodiment is a full color image forming apparatus which uses an intermediary transfer belt as a member to be transferred. FIG. 13 is a typical schematic block diagram of the image forming apparatus.

Y, M, C and Bk are four image forming means portions from the 1st to the 4th which form images of different colors, respectively and are the same as the four image forming means portions from the 1st to the 4th of the above described embodiment 3 and therefore the same descriptions thereof will be omitted.

Reference numeral 36 denotes an intermediary transfer belt, which is arranged in such a manner that it abuts against all of the four photosensitive drums 30*a* to 30*d* of the four image forming means portions Y, M, C and Bk from the 1st to the 4th.

On this occasion, primary transfer rollers 35 which are shown below are in a state of being not abutted against the intermediary transfer belt 36 and the nips formed between the intermediary transfer belt 36 and the photosensitive drums 30*a* to 30*d* were set in such a manner as to be equal to or more than 0.5 mm.

The intermediary transfer belt 36 is supported by three rollers of the driving roller 24, the slave roller 25 and a secondary transfer opposite roller 26 and an adequate tension is arranged to be maintained. By driving the driving roller 24, the intermediary transfer belt 36 moves in the forward direction almost at the same velocity for the photosensitive drums 30*a* to 30*d*.

For the intermediary transfer belt 36, for example, a resin material having 50 to 300 $\mu$m and a volume resistivity of about $10^9$ to $10^{16}$ Ω·cm such as PVdF (polyvinyliden fluoride), polyamide, polyimide, PET (polyethylene terephthalate), polycarbonate and the like, or a rubber material having a thickness of 0.5 to 2 mm and a volume resistivity of about $10^9$ to $10^{16}$ Ω·cm such as chloroprene rubber, EPDM (ethylene-propylene-diene terpolymer), NBR (nitril butadiene rubber), urethane rubber and the like are used. Further, when occasion demands, there are some cases where, to these materials, an electrically conductive filler such as carbon, ZnO, $SnO_2$, $TiO_2$ and the like is dispersed and adjusted to a volume resistivity of about $10^7$ to $10^{11}$ Ω·cm. Further, according to a main body layout of the image forming apparatus, it is possible to simplify a constitution by adapting two rollers instead of the intermediary transfer belt 36 or by using a intermediary transfer belt which forms a functional layer on a cylinder peripheral surface as the intermediary transfer member instead of the intermediary transfer belt 36.

Next, on the reverse side of the intermediary transfer belt 36 and in the opposing portions to the photosensitive drums 30*a* to 30*d*, primary transfer rollers 35 are arranged by abutting correspondingly against each of the photosensitive drums 30*a* to 30*d*. The primary transfer roller 35 will be described in detail later.

On the occasion of the primary transfer of the toner images to the intermediary transfer belt 36, a positive DC bias is applied independently to each of the primary transfer rollers 35.

According to the distance between the primary transfer positions of each color, by delaying a writing signal from a controller at a predetermined timing for each color, an electrostatic latent image by the exposure is formed on each photosensitive drum 1, and these latent images are primarily transferred in order on the intermediary transfer belt 36 by the operation of a primary transfer roller 23 and multi-images are formed on the intermediary transfer belt 36.

After that, a bias of the polarity in reverse to the toner is applied from the reverse surface of the intermediary transfer belt 36 to the secondary transfer roller 27 which is abut-arranged on the intermediary transfer belt 36 surface (image bearing surface) in opposition to the secondary transfer opposite roller 26 abut-arranged. On this occasion, accompanied by the electrostatic latent image formation by the exposure, the recording paper P which is a transferring material fed from a cassette 29 or a multi-feeder (not shown) passes through between the intermediary transfer belt 36 and the secondary transfer roller 25, so that four color multi-toner images borne on the intermediary transfer belt 36 are secondary-transferred collectively on the recording paper P.

As for the secondary transfer roller 25, for example, a constitution covered by an elastic member with a metallic core having a volume resistivity adjusted to $10^6$ to $10^9$ Ω·cm such as EPDM, urethane rubber, CR, NBR and the like can be used.

Further, the secondary transfer roller 25 was abutted against each of the photosensitive drums 30*a* to 30*d* with a linear load of about 5 to 15 g/cm and yet was installed in such a manner as to rotate in the forward direction at almost equal speed relative to the moving direction of the intermediary transfer belt 36.

On the other hand, after the secondary transfer is completed, the transfer residual toner remaining on the intermediary transfer belt 36 and paper dust generated by the recording paper P being conveyed are removed and recovered from the surface by belt cleaning means 28 which is abut-arranged on the intermediary transfer belt 36. In the image forming apparatus of the present embodiment, as the belt cleaning means 28, a brush roller abut-arranged on the surface of the intermediary transfer member 22 was used, but a cleaning blade and the like having an elasticity which is formed by, for example, urethane rubber and the like can also be used. Further, relative to the moving direction on the intermediary transfer belt 36, by arranging the cleaning blade in the upstream side and the brush roller in the downstream side, it is possible to increase a cleaning efficiency much more.

The transferring material after the secondary transfer is conveyed to fixing means 37 and, upon being fixed with the toner image, is discharged outside the image forming apparatus as an image forming by-product (a print, a copy).

Due to the cleaning by the belt cleaning means 28, the paper dust and like remain without being removed from the member to be transferred such as the recording paper P or the intermediary transfer belt 36 and the like and, when the paper dust are drawn in and adhere on the photosensitive drum, a smeared image sometimes occurs.

Further, as the image forming process advances, the toner image recorded on the member to be transferred by the image forming means arranged in the upstream side of the image forming process is brought into contact with the photosensitive drum mounted on the image forming means of each color by the image forming means arranged in the downstream side. On that occasion, there are some cases where the toner of the color to be used in the image forming means positioned in the upstream adheres to each photosensitive drum. That is, a retransfer sometimes occurs.

As described above, the toner adhered on the photosensitive drum by the image forming means positioned in the downstream side of the image forming process is allowed to be recovered by the developing device of each different color and recycled and consequently an image defect due to mixed colors occurs in the output image. This tendency markedly occurs more often in the image forming means of the colors positioned in the downstream side of the image forming process.

In the image forming apparatus of the present embodiment, in order to control the influence of the image defect as described above, the arrangement of the image forming means according to each color was made in order of Y, M, C and Bk.

Because the yellow toner is low in visibility compared to the toner of other colors, by making the first color of the image forming means yellow, the image defect as described above is difficult to make visible in the output image actually obtained.

Accordingly, in the image forming apparatus of the present embodiment as described above, by arranging the image forming means of yellow in the first color, the influence caused by the image defect in the output image could be controlled to the minimum possible level.

As described above, in the image forming apparatus of the present embodiment which uses the intermediary transfer member 36, the transfer efficiency when the toner image is primarily transferred from the photosensitive drum surface to the intermediary transfer member is almost constant regardless of the material or the thickness of the recording paper P and the difference in resistance and the like.

Further, because high transfer efficiency can be stably obtained under various circumstances, the amount of the transfer residual toner which remains on the photosensitive drum surface and is recovered by the developing means is almost constant and its absolute amount is also reduced. Accordingly, the toner recycle process in which the direct injection charging is executed for the photosensitive drum surface and the residual transfer toner is recovered by the developing device can always be effectively executed in a more stable state.

Further, because the secondary transfer toner which was not transferred on the recording material P is removed by the belt cleaning means, the worsening of the quality of the image outputted by the image forming apparatus due to direct adhesion of the paper dusts on the photosensitive drums 30*a* to 30*d* and flow thereof into the charging means 31*a* to 31*d* or developing means 33*a* to 33*d* can be prevented.

In view of the above described points, in comparison, the image forming apparatus of the present embodiment which uses the intermediary transfer member 36 is more advantageous in attempting to stabilize the apparatus than the image forming apparatus which adopts the electrostatic conveying belt system.

As described above, in the image recording apparatus according to the present embodiment, the topmost surface of the charging member in the image forming means is porous and abutted against the image bearing member at a peripheral velocity difference provided, and the charging member is applied with the alternating current voltage superposed with the direct current voltage. The developing means is provided with the cleanerless system for executing the cleaning simultaneous with developing in a state of abutting against the image bearing member. As a result, even in the image forming apparatus comprising a plurality of image forming means, while preventing the reverse charging of the toner by the direct charging (the injection charging) system, the toner is discharged from the charging member and brought into contact with the developing means to execute the cleaning simultaneous with developing, so that a color image with little image fog can be maintained over a long period of time.

(Others)

1) As for the alternating current voltage component of the waveform of the charging bias or the developing bias, a sine wave, a rectangular wave, a chopping wave and the like can be used as occasion demands. Further, it may be the rectangular wave, which is formed by periodically turning on/off the direct current power source. In this way, as for the waveform of the alternating current voltage, a bias such as periodically changing in its voltage value can be used.

2) As for the image exposing means for an electrostatic latent image formation, it is not limited to laser scanning exposing means which forms the digital latent image like the embodiment, but may be another light emitting element such as the normal analogue image exposure, LED and the like, or may be those capable of forming the electrostatic latent image corresponding to the image information such as a combination of the light emitting element of a fluorescent lamp and a liquid crystal shutter and the like.

3) The image bearing member 1 may be the electrostatic recording dielectrics. In this case, after the surface of the dielectrics are uniformly primary-charged to a predetermined polarity and potential, it is selectively charge-neutralized by charge-neutralizing means such as a charge-neutralizing needle head, an electron gun and the like and an object electrostatic latent image is written and formed.

4) Although the developing device 5 was described in the embodiment with reference to the example of the reversal developing device using the nonmagnetic one-component toner as the developer, the constitution of the developing device is not particularly limited. It may be a normal developing device.

In general, the developing methods of the electrostatic latent image are broadly classified into four types such as the method (one-component noncontact developing) in which the nonmagnetic toner is coated on a developer bearing conveying member such as a sleeve and the like by a blade and the like and the magnetic toner is coated on the developer bearing conveying member by a magnetic force, and they are conveyed and applied to the image bearing member in a noncontact state to develop the electrostatic latent image, the method (one-component contact developing) in which the toner which is coated on the developer bearing conveying member as described above is applied to the image bearing member in a contact state to develop the electrostatic latent image, the method (two-component contact developing) in which the toner particles mixed with the magnetic carrier are used as the developer (the two-component developer) and conveyed by a magnetic force and applied to the image bearing member in a contact state to develop the electrostatic latent image and the method (two-component noncontact developing) in which the above described two-component developer is applied to the image bearing member in a noncontact state to develop the electrostatic latent image.

As described above, in the image forming apparatus, comprising the image bearing member and a flexibility for charging the above described image bearing member, wherein the contact charging means in which the outer peripheral surface is at least porous and the above described developing means recover the developer remaining on the image bearing member, at least between the above described contact charging means and image bearing member there are interposed electrically conductive particles and, at least at the image forming time, the direct current voltage superposed with the alternating current voltage in which the peak to peak voltage is within the range less than the charge potential convergent voltage is applied, so that the residual transfer toner can be effectively scratched off from the image bearing member and further the toner discharging can be expedited from the charging member also, and thus an excellent chargeability can be stably obtained.

Further, by contacting the image bearing member and executing the cleaning simultaneous with developing, the apparatus is not affected by a deflection of the charging potential and it became possible to obtain high quality output image with little image fog over a long period of time.

Compared to the conventional image forming apparatus using the charging system, which mainly utilizes the discharging operation, in the image forming apparatus of the present invention which is constituted in such a manner that the direct charging operation becomes dominant, despite the fact that the voltage in which the direct current voltage is superposed with the alternating current voltage is applied, the generation of ozone from the charging means was rapidly reduced.

Further, in the above described image forming apparatus, the cleanerless system of the image bearing member can be realized with a simple constitution, and a substantial miniaturization of the apparatus and recycling of the toner can be attempted. Furthermore, by applying the charging system of the present invention to the color image forming apparatus, the cleanerless constitution by a simple constitution can also be realized in the color image forming apparatus and it became possible to attempt its miniaturization.

What is claimed is:

1. An image forming apparatus comprising:

an image bearing member;

a flexible charging member for charging said image bearing member, wherein a nip portion is formed between said charging member and said image bearing member, said charging member being applied with a voltage when said charging member at least charges said image bearing member for an image formation, said nip portion being provided with electrically conductive particles; and developing means for developing an electrostatic image formed on said image bearing member with a developer, said developing means executing a developing operation and, at the same time, executing a collecting operation for collecting a residual developer on said image bearing member, wherein the voltage is a superposed voltage with a direct current voltage and an alternating current voltage having a peak to peak voltage, which is less than a peak to peak voltage of the alternating current voltage applied to said charging member when the charging potential of said image bearing member converges under the condition that said charging member charges said image bearing member without the conductive particles.

2. An image forming apparatus according to claim 1, wherein said charging member includes a foam layer formed on a surface thereof and said foam layer bears and carries the electrically conductive particles.

3. An image forming apparatus according to claim 1, wherein said electrically conductive particles are provided with a frictional charged polarity for charging said developer to a normal charged polarity.

4. An image forming apparatus according to claim 1, wherein said charging member scrapes off the developer on said image bearing member and, at the same time, the scraped off developer is charged to the normal polarity and discharges the developer in a downstream side of said nip portion in a moving direction of said image bearing member.

5. An image forming apparatus according to claim 1 or 4, wherein said charging member is capable of rotating in a direction, which is counter to a rotational direction of said image bearing member at said nip portion.

6. An image forming apparatus according to claim 1, wherein said charging member is provided with a different peripheral velocity with respect to a peripheral velocity of said image bearing member.

7. An image forming apparatus according to claim 1, wherein the peak to peak voltage is equal to or more than 500 V.

8. An image forming apparatus according to claim 1 or 7, wherein the peak to peak voltage is less than 1200 V.

9. An image forming apparatus according to claim 1, wherein a particle size of the electrically conductive particles is more than 0.1 and is equal to or less 3 $\mu$m.

10. An image forming apparatus according to claim 1, wherein said electrically conductive particles have a resistivity equal to or less than $10^{12}$ Ωcm.

11. An image forming apparatus according to claim 1, further comprising transfer means for transferring an image formed on said image bearing member to a member to be transferred and the developer, which remains on said image bearing member after the transfer by said transfer means, reaches said nip portion.

12. An image forming apparatus according to claim 11, wherein said member to be transferred is one of a sheet and an intermediary transfer member on which an image is transferred from said image bearing member.

13. An image forming apparatus according to claim 1, wherein said image bearing member includes electrostatic image forming means for forming the electrostatic image on said image bearing member charged by said charging member.

14. An image forming apparatus according to claim 13, wherein said image bearing member is a photosensitive member and said electrostatic image forming means includes an exposing means for exposing said photosensitive member.

15. An image forming apparatus according to claim 1, wherein said developing means includes a developer carrying member for carrying said developer and said developer carrying member is disposed so as to contact said image bearing member.

16. An image forming apparatus according to claim 1, wherein the developer to be used by said developing means has a shape factor SF-1 of 100 to 150 and a shape factor SF-2 of 100 to 140.

17. An image forming apparatus according to claim 1, further comprising a plurality of each of said image bearing member, said charging member, and said developing means, and the images formed on said plurality of image bearing members are transferred to a member to be transferred.

18. An image forming apparatus according to claim 17, wherein, in one image bearing member in which an image is formed first among said plurality of image bearing members, an image of the developer of a color whose visibility is the lowest among the developer of each color to be used in said image forming apparatus is formed.

19. An image forming apparatus according to claim 1, wherein said image bearing member and said charging member are provided in a process cartridge detachably attachable to a main body of said image forming apparatus.

20. An image forming apparatus according to claim 1, wherein said charging member is in a roller shape.

* * * * *

UNITED STATES PATENT AND TRADEMARK OFFICE

CERTIFICATE OF CORRECTION

PATENT NO. : 6,611,669 B2
DATED : August 26, 2003
INVENTOR(S) : Jun Suzuki et al.

It is certified that error appears in the above-identified patent and that said Letters Patent is hereby corrected as shown below:

Column 8,
Line 10, “In” should read -- in --.

Column 10,
Line 66, “Periphery” should read -- Periphery. --.

Column 12,
Line 50, “It” should read -- it --.

Column 21,
Line 16, “wave” should read -- wave. --.

Column 22,
Line 24, “provided,” should read -- provided. --.

Signed and Sealed this

Thirteenth Day of January, 2004

JON W. DUDAS
*Acting Director of the United States Patent and Trademark Office*